US010045403B2

(12) United States Patent
Hosokawa et al.

(10) Patent No.: US 10,045,403 B2
(45) Date of Patent: Aug. 7, 2018

(54) MICROWAVE HEATING DEVICE

(71) Applicant: Panasonic Corporation, Kadoma-shi, Osaka (JP)

(72) Inventors: Daisuke Hosokawa, Shiga (JP); Koji Yoshino, Shiga (JP); Makoto Nishimura, Shiga (JP); Masafumi Sadahira, Shiga (JP); Tomoya Fujinami, Shiga (JP); Tomotaka Nobue, Nara (JP); Yoshiharu Omori, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 850 days.

(21) Appl. No.: 14/382,669

(22) PCT Filed: Jan. 30, 2013

(86) PCT No.: PCT/JP2013/000491

§ 371 (c)(1),
(2) Date: Sep. 3, 2014

(87) PCT Pub. No.: WO2013/132740

PCT Pub. Date: Sep. 12, 2013

(65) Prior Publication Data

US 2015/0173128 A1 Jun. 18, 2015

(30) Foreign Application Priority Data

Mar. 9, 2012 (JP) ..... 2012-052654

(51) Int. Cl.
*H05B 6/64* (2006.01)
*H05B 6/70* (2006.01)

(52) U.S. Cl.
CPC ..... *H05B 6/6402* (2013.01); *H05B 6/70* (2013.01); *H05B 6/708* (2013.01)

(58) Field of Classification Search
CPC ..... H05B 6/70; H05B 6/6402; H05B 6/708
(Continued)

(56) References Cited

U.S. PATENT DOCUMENTS 3,975,606 A 8/1976 Tanaka et al.
4,301,347 A 11/1981 Quine
(Continued)

FOREIGN PATENT DOCUMENTS

CN 1496195 A 5/2004
JP 57-55089 A 4/1982
(Continued)

OTHER PUBLICATIONS

Translation of JPS59198697, High Frequency Heating Apparatus,Nov. 10, 1984, European Patent Office.*
(Continued)

*Primary Examiner* — Quang Van
(74) *Attorney, Agent, or Firm* — Brinks Gilson & Lione

(57) ABSTRACT

A microwave heating device of the present invention comprises a heating chamber housing an object to be heated, a microwave generation portion generating a microwave, a waveguide portion propagating the microwave, and a plurality of microwave radiating portions radiating the microwave in the heating chamber, wherein the microwave radiating portions are arranged in a direction orthogonal to a direction of electric field and to a direction of propagation within the waveguide portion, and centers of the microwave radiating portions are arranged at positions corresponding to approximate node positions of the electric field within the waveguide portion. The microwave heating device is enabled to make uniform heat distribution in the object to be heated, without using a driving mechanism.

8 Claims, 13 Drawing Sheets

(58) Field of Classification Search
USPC ..... 219/695, 696, 697, 746, 747, 748, 750, 219/756
See application file for complete search history.

(56) References Cited

U.S. PATENT DOCUMENTS

| | | | | |
|---|---|---|---|---|
| 4,464,554 | A * | 8/1984 | Bakanowski | H05B 6/72 219/746 |
| 5,932,131 | A | 8/1999 | Joo et al. | |
| 5,986,249 | A | 11/1999 | Yoshino et al. | |
| 6,097,018 | A * | 8/2000 | Kim | H05B 6/704 219/695 |
| 6,172,348 | B1 | 1/2001 | Yoshino et al. | |
| 6,274,859 | B1 | 8/2001 | Yoshino et al. | |
| 2005/0230385 | A1 | 10/2005 | Lee et al. | |
| 2008/0272114 | A1 | 11/2008 | Taguchi et al. | |
| 2012/0160844 | A1 | 6/2012 | Nobue et al. | |

FOREIGN PATENT DOCUMENTS

| | | | |
|---|---|---|---|
| JP | 57-148797 | U | 9/1982 |
| JP | 59-198697 | A | 11/1984 |
| JP | 62-64093 | A | 3/1987 |
| JP | 8-138857 | A | 5/1996 |
| JP | 08-166133 | A | 6/1996 |
| JP | 09-022775 | A | 1/1997 |
| JP | 3510523 | B2 | 1/2000 |
| JP | 2001-319768 | A | 11/2001 |
| JP | 2003-151758 | A | 5/2003 |
| JP | 3510523 | B2 | 3/2004 |
| JP | 2005-235772 | A | 9/2005 |
| JP | 2008-166092 | A | 7/2008 |
| JP | 2008-276986 | A | 11/2008 |
| WO | WO 2011/027571 | A1 | 3/2011 |
| WO | WO 2012/137447 | A1 | 10/2012 |

OTHER PUBLICATIONS

Extended European Search Report in corresponding European Application No. 13757233.5, dated Feb. 24, 2015, 7 pages.
International Search Report in corresponding International Application No. PCT/JP2013/000491, dated Mar. 19, 2013, 2 pages.
Office Action and Search Report, and partial English language translation thereof, in corresponding Chinese Application No. 201380024346.9, dated May 20, 2015, 10 pages.
Office Action and English translation of Search Report thereof, in corresponding Chinese Application No. 201380024346.9 dated Feb. 1, 2016, 10 pages.

* cited by examiner

Fig.2
(a)
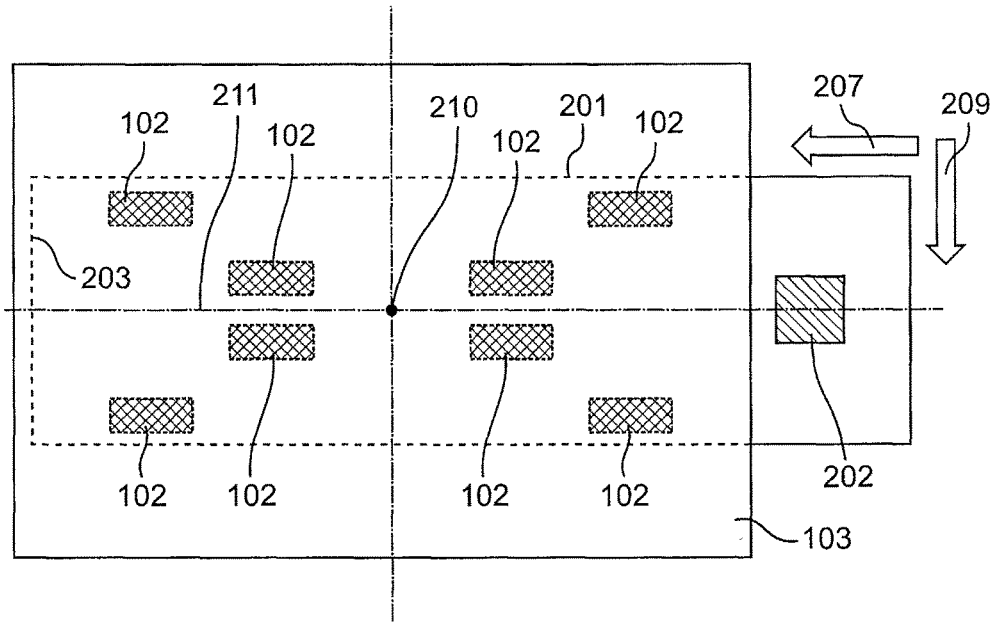
(b)
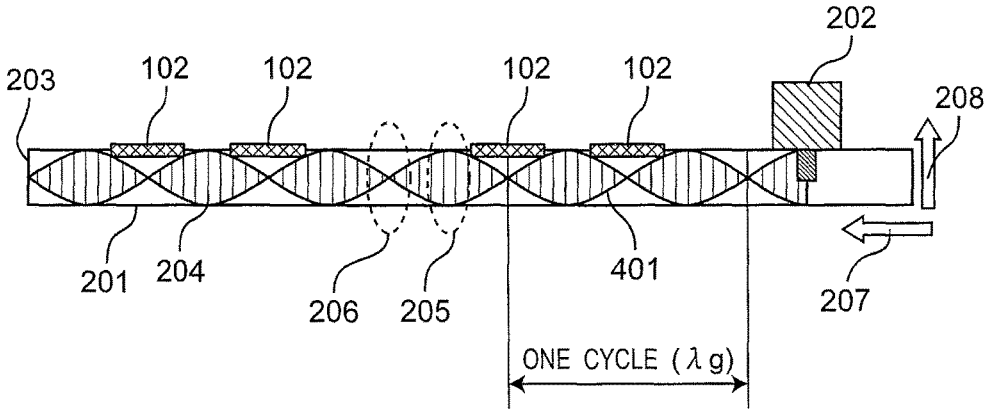

*Fig.5*

(a)

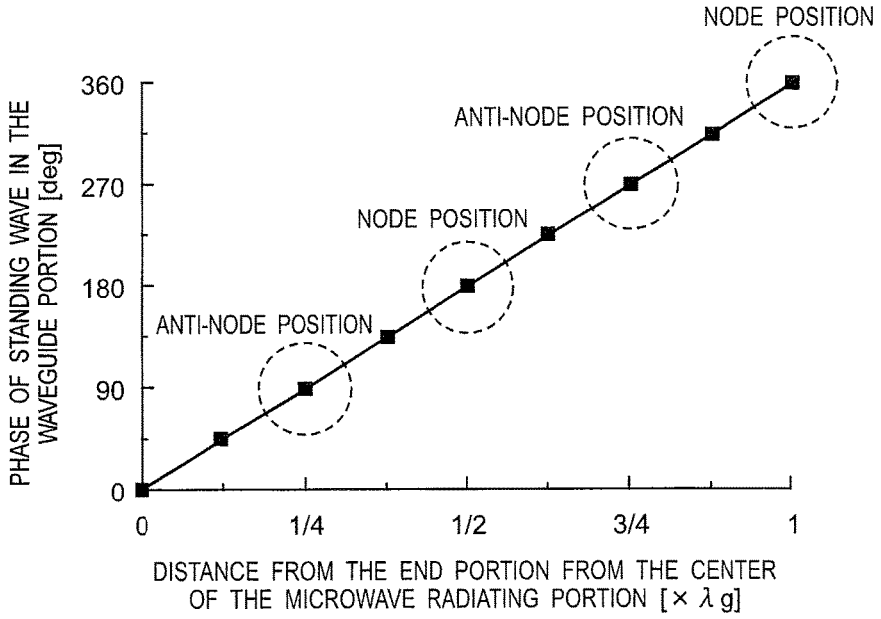

(b)

| LENGTH OF WAVEGUIDE PORTION [mm] | NUMERICAL APERTURE | LENGTH OF SLIT [mm] | BOUNDARY CONDITION IN THE HEATING CHAMBER | PRESENTATION DATA | THICKNESS OF THE WAVEGUIDE PORTION [mm] | DISTANCE FROM THE END PORTION OF THE WAVEGUIDE PORTION TO THE CENTER OF THE MICROWAVE RADIATING PORTION | | | |
|---|---|---|---|---|---|---|---|---|---|
| | | | | | | 1/4 · λ g (ANTI-NODE POSITION) | 3/8 · λ g | 1/2 · λ g (NODE POSITION) | 7/8 · λ g |
| 327 | 1 | 55 | RADIATION | EFFECTIVE ELECTRIC FIELD | 30 | 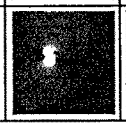 | 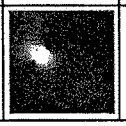 | 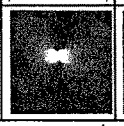 | 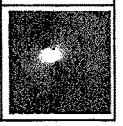 |

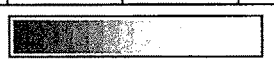

0~500 V/m

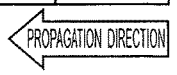

Fig.6
(a)
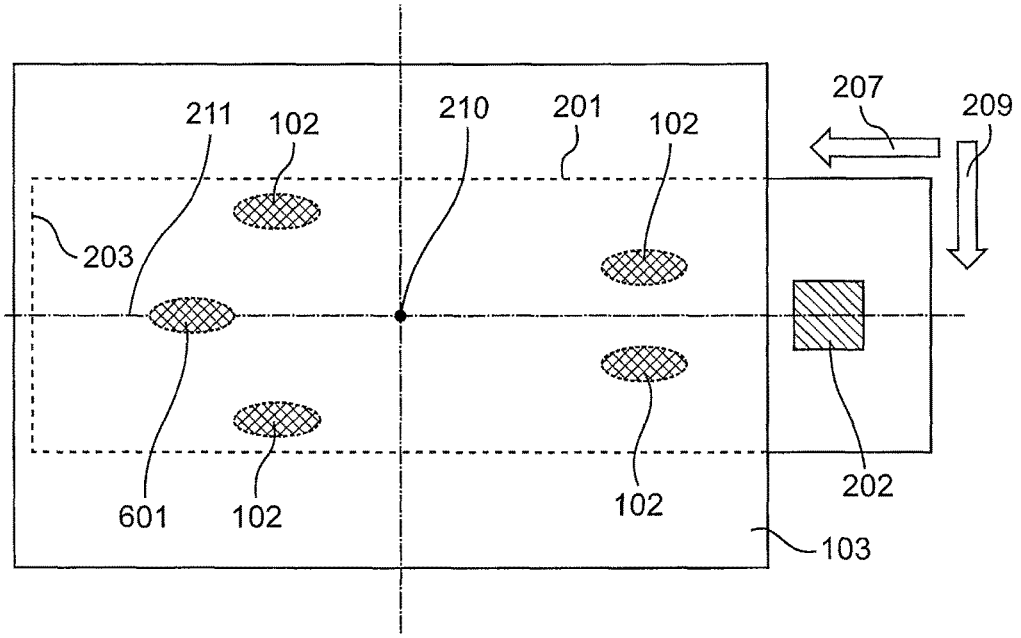
(b)
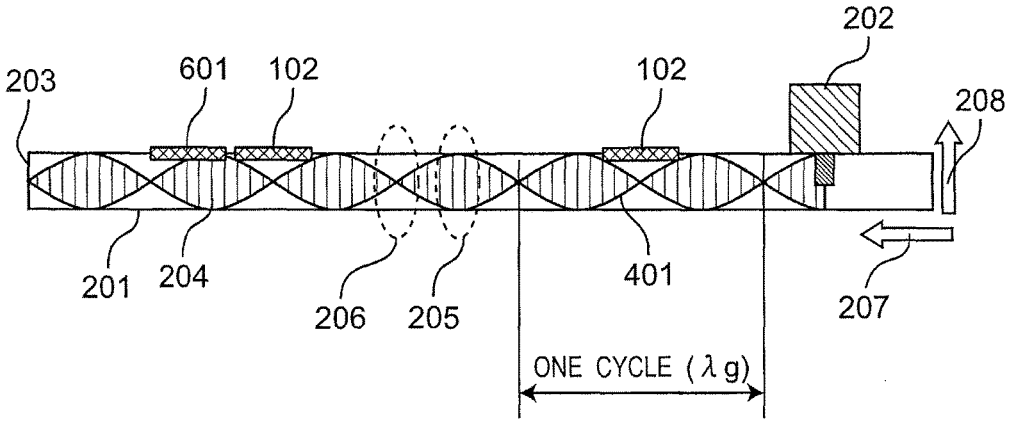

Fig.7
(a)
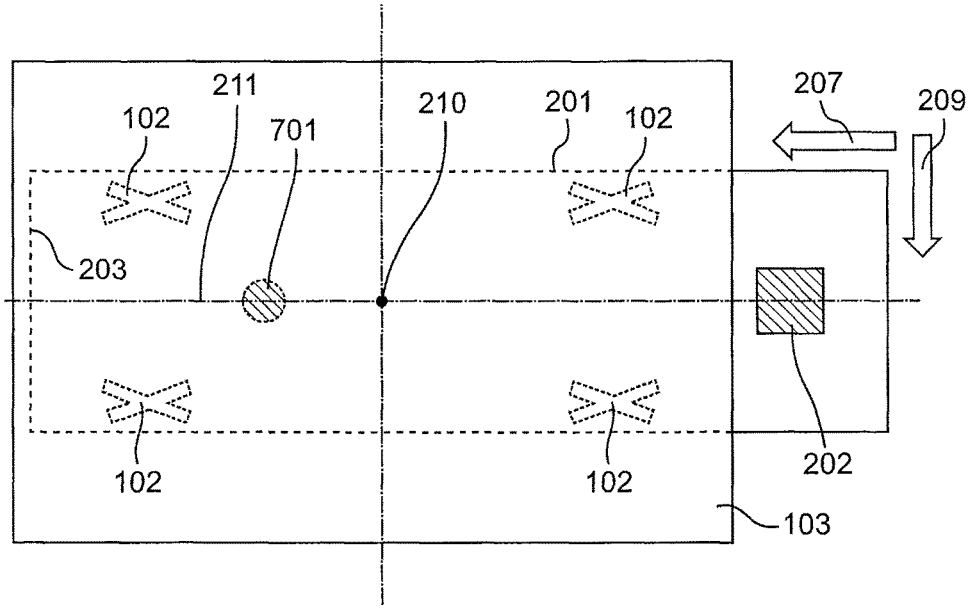
(b)
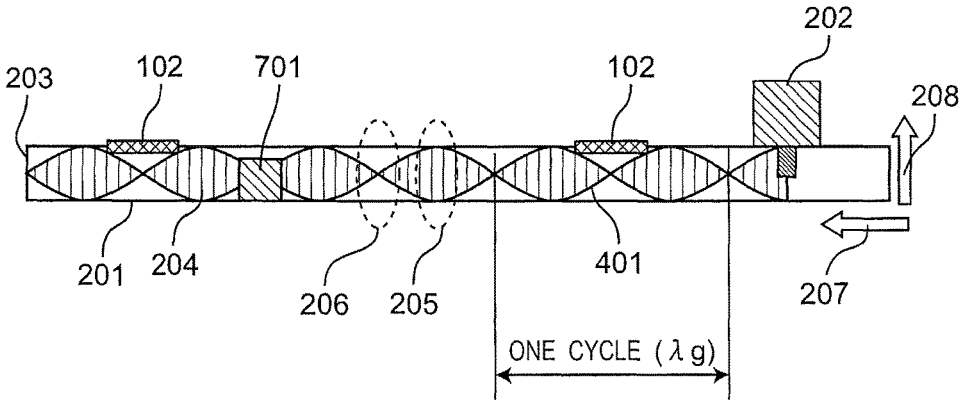

*Fig.8*

(a)

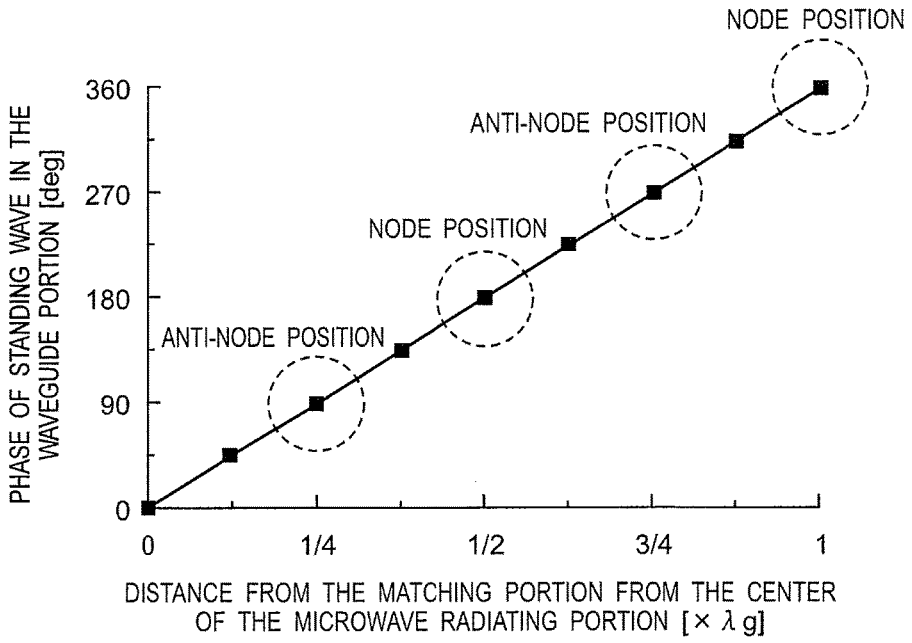

(b)

| LENGTH OF WAVEGUIDE PORTION [mm] | NUMERICAL APERTURE | LENGTH OF SLIT [mm] | BOUNDARY CONDITION IN THE HEATING CHAMBER | PRESENTATION DATA | THICKNESS OF THE WAVEGUIDE PORTION [mm] | DISTANCE FROM THE MATCHING PORTION FOR ADJUSTING IMPEDANCE TO THE CENTER OF THE MICROWAVE RADIATING PORTION | | | |
|---|---|---|---|---|---|---|---|---|---|
| | | | | | | 1/4・λg (ANTI-NODE POSITION) | 3/8・λg | 1/2・λg (NODE POSITION) | 7/8・λg |
| 327 | 1 | 55 | RADIATION | EFFECTIVE ELECTRIC FIELD | 30 | 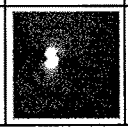 | 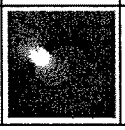 | 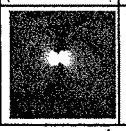 | 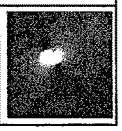 |

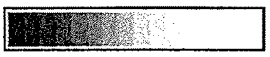

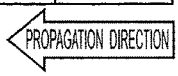

Fig.9
(a)
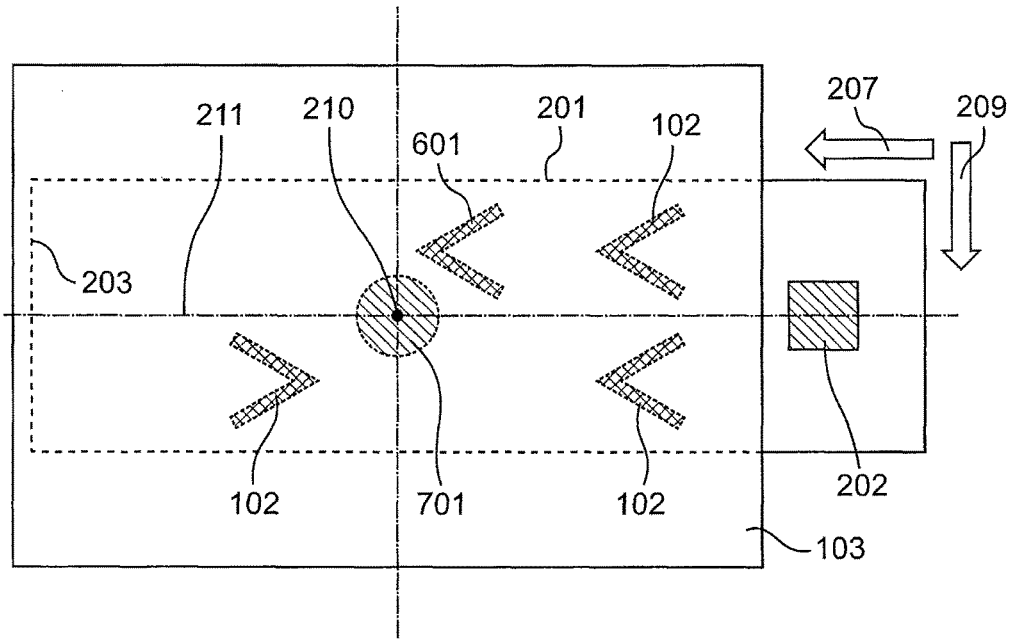
(b)
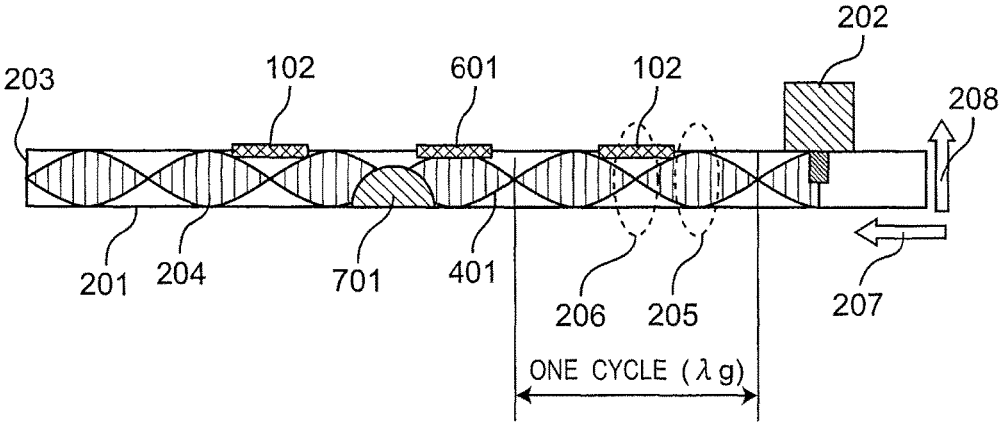

Fig.10
(a)
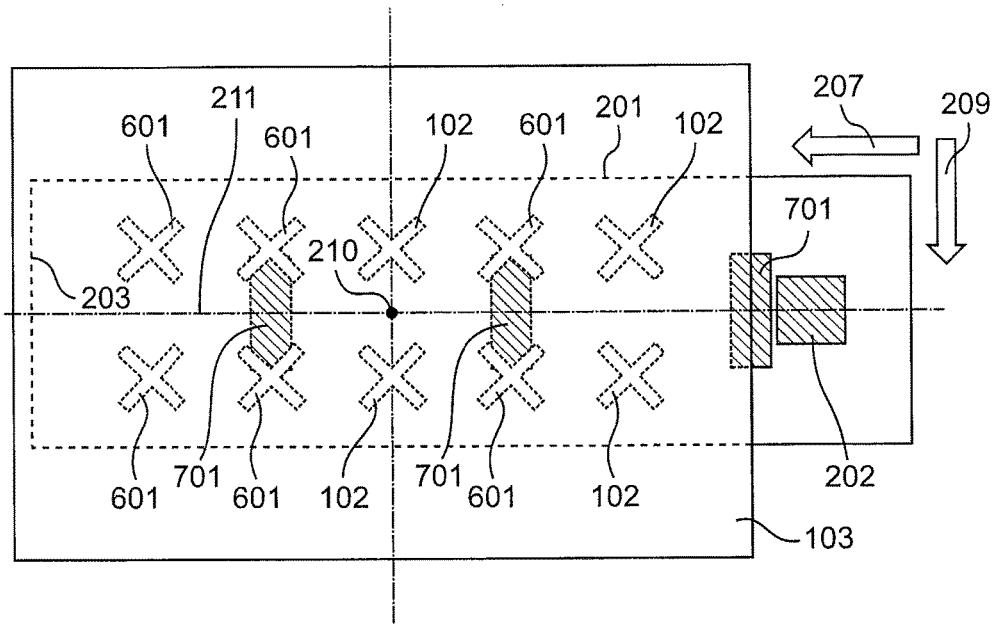
(b)
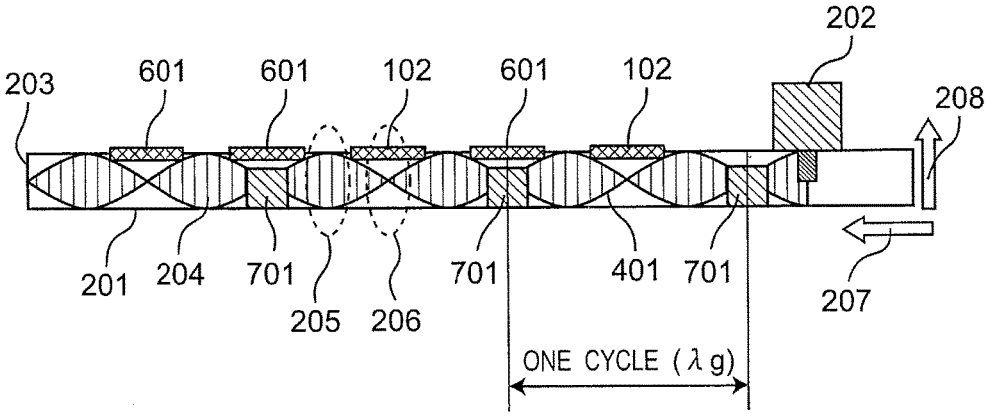

*Fig.14*
(a)
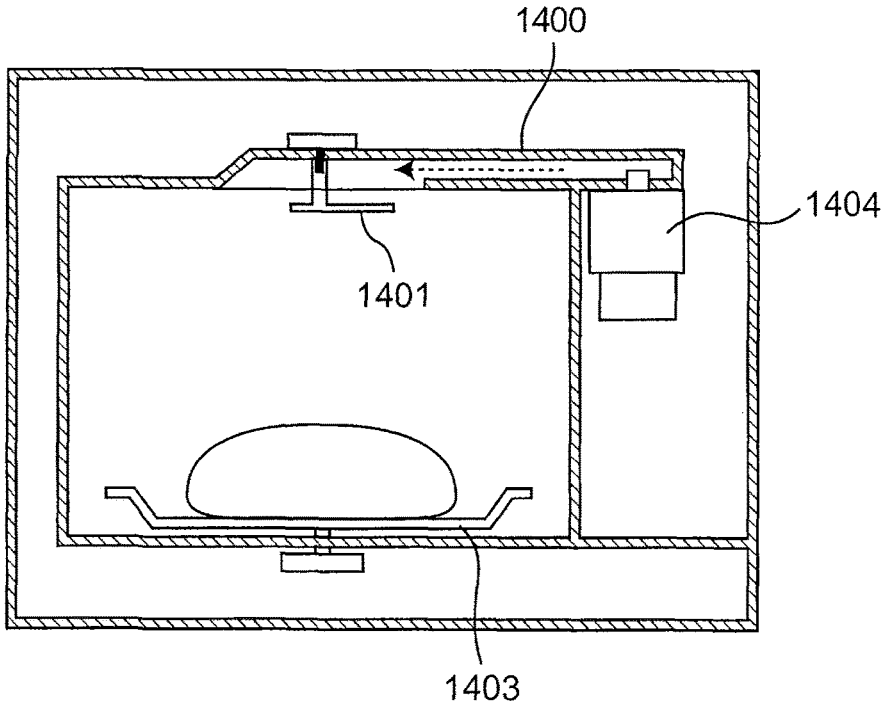
(b)
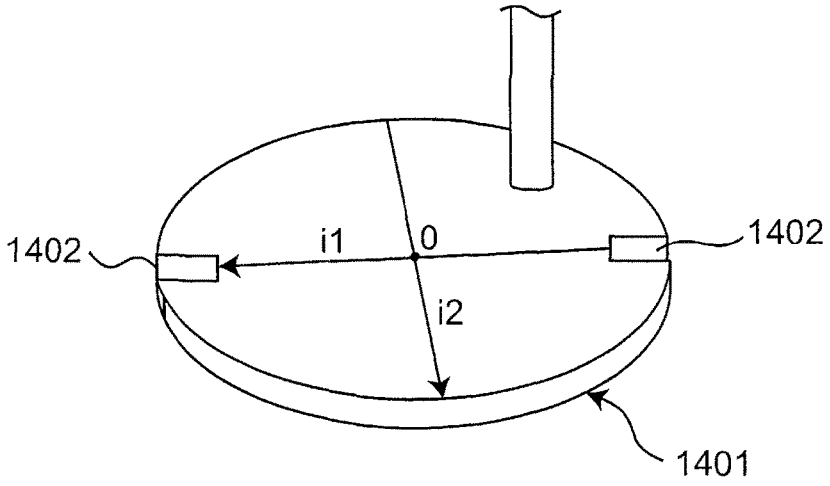

MICROWAVE HEATING DEVICE

This application is a 371 application of PCT/JP2013/000491 having an international filing date of Jan. 30, 2013, which claims priority to JP2012-052654 filed Mar. 9, 2012, the entire contents of which are incorporated herein by reference.

TECHNICAL FIELD

The present invention relates to microwave heating devices such as microwave ovens which radiate microwaves to objects to be heated so as to perform dielectric heating and, more particularly, relates to microwave heating devices including microwave radiating portions with characteristic structures.

BACKGROUND ART

As representative apparatuses among microwave heating devices for performing heating processing on objects through microwaves, there have been microwave ovens. A microwave oven is adapted to radiate microwaves generated from a microwave generator to the inside of a metallic heating chamber, thereby causing an object to be heated within the heating chamber to be subjected to dielectric heating through radiated microwaves.

Conventional microwave ovens have employed magnetrons as such microwave generators. Such a magnetron generates microwaves, which are radiated to the inside of the heating chamber through a waveguide tube. A non-uniform microwave electromagnetic-field distribution (microwave distribution) within the heating chamber causes that uniform microwave heating for the object cannot be performed.

As means for uniformly heating an object to be heated within a heating chamber, there is a mechanism adapted to rotate a table on which an object to be heated is placed so as to rotate the object to be heated, a mechanism adapted to rotate an antenna which radiates microwaves while fixing the object to be heated, or a mechanism adapted to shift phases of microwaves from microwave generator using a phase shifter. It is a general method for heating uniformly to an object that the object to be heated is heated with changing directions of the microwaves radiated to the object by using any driving mechanism as mentioned above.

On the other hand, in order to constitute simply, a method of carrying out uniform heating without having drive mechanism is demanded, and the method of using a circular polarization of which a polarization plane of electric field rotates in time is proposed. Since dielectric heating is carried out on the basis of the principle that to-be-heated an object having dielectric loss is heated with the electric field of microwave, it is thought that using the circular polarization of which an electric field rotates has an effect in equalization of heating.

As concrete way for generating the circular polarization, for example, as shown in FIG. 12, U.S. Pat. No. 4,301,347 (Patent Literature 1) discloses a structure using a circular polarization opening 1202 of an X shape which is formed to have a crossing shape on a waveguide tube 1200. Also, Japanese Patent No. 3510523 (Patent Literature 2) discloses a structure which arranges two openings 1301 of rectangular slits to be extended in a direction perpendicular on a waveguide tube 1300, and the openings 1301 are arranged to have an interval apart from each other, as shown in FIG. 13. Furthermore, Unexamined Japanese Patent Publication No. 2005-235772 (Patent literature 3) discloses a patch antenna 1401 which is connected to waveguide tube 1400 for propagating microwaves from a magnetron 1404, as shown in FIG. 14. The patch antenna 1401 is configured to generate a circular polarization with cut portions 1402 which are formed on a plane of the patch antenna 1401.

For example, some conventional microwave heating devices have been structured to have a rotatable antenna and an antenna shaft which are arranged within a waveguide tube and, further, to drive a magnetron while rotating this antenna through a motor, thereby alleviating the non-uniformity in the microwave distribution within the heating chamber.

Further, Unexamined Japanese Patent Publication No. S 62-64093 (Patent Literature 4) suggests a microwave heating device which is provided with a rotatable antenna at a lower portion of a magnetron and is adapted to direct air flows from a blower fan to the blades of this antenna for rotating the antenna by the wind power from the blower fan, in order to change the microwave distribution within the heating chamber.

As an example of provision of such a phase shifter, Patent Literature 1 describes the microwave heating device which is adapted to alleviate heating unevenness in an object to be heated through microwave heating and to reduce a space of feeding portions. This Patent Literature 1 suggests the microwave heating device having a rotary phase shifter 1201 and a single microwave radiating portion 1202 for radiating circularly-polarized waves within the heating chamber, as shown in FIG. 12.

CITATION LIST

Patent Literature

Patent Literature 1: U.S. Pat. No. 4,301,347

Patent Literature 2: Japanese Patent Publication No. 3510523

Patent Literature 3: Unexamined Japanese Patent Publication No. 2005-235772

Patent Literature 4: Unexamined Japanese Patent Publication No. S 62-64093

SUMMARY OF THE INVENTION

Technical Problem

Microwave heating devices as microwave ovens having conventional structures as described above have been required to have a simplest possible structure and to be capable of heating objects to be heated with higher efficiency and with no unevenness. However, conventional structures which have been ever suggested have not been satisfied and have had various problems in terms of structures, efficiency and uniformity.

Further, there has been advancement of technical developments for increasing the outputs of microwave heating devices, particularly microwave ovens, and products with a rated high-frequency output of 1000 W have been commercialized domestically. As products, microwave ovens have the significant property of having convenience of directly heating foods using dielectric heating, rather than heating foods using heat conduction. However, in a state where non-uniform heating has not been overcome in such microwave ovens, there has been a significant problem in that increasing of outputs makes such non-uniform heating more manifest.

Conventional microwave heating devices have had the problems in structure, as the following three points.

The first point is as follows. In order to alleviate non-uniform heating, there has been a need for a driving mechanism for rotating a table or an antenna. This requires securing a space for rotation of the table or the antenna, and an installation space for a driving source such as a motor for rotating the table or the antenna, and therefore, size reduction of microwave ovens is obstructed.

The second point is as follows. In order to stably rotate the antenna, it is necessary to provide this antenna at an upper portion or a lower portion in the heating chamber, and therefore, the placement of particular members in the structure is restricted.

The third point is as follows. Since appearance of microwave ovens having various heating functions, such as vapor heating and/or hot-wind heating, many component parts is needed to be provided inside a case of the microwave oven. Therefore, in this point, the placement of the parts in the structure is restricted. Moreover, in such microwave oven, since there is much calorific value from the control parts etc. inside of the case, in order to realize sufficient cooling capability, it is necessary to secure a cooling air passage in the inside of the case. As a result, it has problems that installation positions of a waveguide tube and a microwave radiation portion are restricted, and the microwave distribution in a heating chamber becomes uneven.

Furthermore, in a space (applicator) which leads to the heating chamber in the conventional microwave heating device and where it is irradiated with microwave, a rotation mechanism of the table or the phase shifter, and other mechanism are installed, and installation of such mechanism causes discharge phenomenon of microwave, and reduces reliability as a device. Therefore, microwave heating devices which become unnecessary these mechanisms and have high reliability have been demanded.

The conventional microwave heating devices using the above-mentioned circular polarization do not have such effect that uniform heating can be performed without the use of such drive mechanism in any case of Patent Literatures 1 to 3. These Patent Literatures 1 to 3 only indicate that equalization can be attained by both effects of the circular polarization and the conventional drive mechanism rather than the only the drive mechanism.

Concretely, Patent Literature 1 shown in FIG. 12 discloses a rotating body called the phase shifter 1201 which is arranged at an end of the waveguide tube 1200. Patent Literature 2 shown in FIG. 13 discloses the turntable for rotating the object to be heated. Also, Patent Literature 3 shown in FIG. 14 discloses a structure which is configured to rotate a patch antenna 1401 used as a stirrer in addition to a turntable 1403. As mentioned above, Patent Literatures 1 to 3 does not disclose such mention that a driving mechanism becomes unnecessary by utilizing the circular polarization. In case that only a circular polarization radiated from a single microwave radiating portion is used in a microwave heating device, and that any drive mechanism is not provided in a microwave heating device, stirring of microwave is insufficient and uniform heating deteriorates in comparison with a structure having general drive mechanism, for example, a structure for rotating the table on which an object to be heated is placed, and a structure for rotating an antenna.

Also, the conventional microwave heating device of Patent Literature 4 is configured to rotate an antenna with cooling air from a blower, and to arrange a rotating mechanism in the applicator. As a result, it had problems in reduced reliability as a device and in uniformity of the microwave distribution in the heating chamber.

The present invention is made to overcome the aforementioned various problems in the conventional microwave heating device and aims at providing a microwave heating device capable of uniform microwave heating of an object to be heated, without using a driving mechanism. In case that a circular polarization is radiated from the opening of the waveguide tube as shown in FIG. 12 and FIG. 13, the opening cannot be arranged outside from width of the waveguide tube. Therefore, the present invention solves a problem that microwaves cannot be spread outside from the width of the waveguide tube. The present invention provides a structure which can spread microwaves in a direction of the width of the waveguide tube, and can be achieve to be uniform microwave distribution in a heating chamber, thereby the object to be heated can be heated uniformly.

Solution to Problem

In order to solve the various problems in the conventional microwave heating devices, a microwave heating device according to the present invention comprises a heating chamber adapted to house an object to be heated;

a microwave generation portion adapted to generate a microwave;

a waveguide portion adapted to propagate the microwave; and a plurality of microwave radiating portions which are provided to the waveguide portion and adapted to radiate the microwave to inside of the heating chamber, wherein the plurality of the microwave radiating portions are arranged in a direction orthogonal to a direction of electric field and to a direction of propagation within the waveguide portion, and centers of at least two the microwave radiating portions of the plurality of microwave radiating portions are arranged at positions corresponding to approximate node positions of the electric field within the waveguide portion.

With the structure of the microwave heating device having the aforementioned structure according the present invention, it is possible to radiate microwaves to an outside area from the width of the waveguide portion, because the microwaves are spread mainly in the direction orthogonal to the direction of electric field and to the direction of propagation within the waveguide portion. The microwave heating device is configured to radiate microwaves to inside of the heating chamber from the microwave radiating portions arranged in the direction orthogonal to the direction of electric field and to the direction of propagation within the waveguide portion. As a result, the microwave heating device according to the present invention is enabled to make uniform microwave distribution in the object to be heated, without using a driving mechanism.

Also, in the microwave heating device according to the present invention, spread directions of microwaves radiated from microwave radiating portions to the inside of the heating chamber are changed in accordance with phases of microwaves in a waveguide portion and the positions where the microwave radiating portions are formed. The microwave heating device according to the present invention is enabled to radiate microwaves having directivity in a propagation direction of the waveguide portion, especially by arranging the microwave radiating portions at approximate node position of the microwaves in the waveguide portion.

Therefore, in the microwave heating device according to the present invention, the plurality of the microwave radiating portions are arranged in the direction orthogonal to the direction of electric field and to the direction of propagation within the waveguide portion, and at least two microwave radiating portions of them are arranged at approximate node position of the microwave within the waveguide portion. Therefore, the microwave heating device according present invention is enabled to radiate the microwaves in a propagation direction of the waveguide portion together with in the direction orthogonal to the direction of electric field and to the direction of propagation within the waveguide portion. As a result, the microwave heating device according to the present invention is enabled to make uniform microwave distribution in the object to be heated, without using a driving mechanism.

Advantageous Effects of Invention

According to the microwave heating device of the present invention, microwaves can be radiated in a direction orthogonal to a direction of electric field and to a direction of propagation within a waveguide portion, and in a direction parallel to the propagation of the waveguide portion, by that the plurality of the microwave radiating portions are arranged in the direction orthogonal to the direction of electric field and to the direction of propagation within the waveguide portion and at least two microwave radiating portions of them are arranged at approximate node position of the microwave within the waveguide portion. As a result, the microwave heating device according to the present invention is enabled to make uniform heat distribution in the object to be heated, without using a driving mechanism.

BRIEF DESCRIPTION OF THE DRAWINGS

FIG. 2(*a*) is a plan view showing a waveguide portion and microwave radiating portions and a heating chamber, and FIG. 2(*b*) is a side view explaining a relationship between the microwave radiating portions and an electric field in the waveguide portion of the first embodiment according to the present invention.

FIGS. 5(*a*) and 5(*b*) are diagrams explaining a relationship between a phase of an electric field in the waveguide portion and a directivity of microwaves radiated from the microwave radiating portions of the first embodiment according to the present invention.

FIG. 6(*a*) is a plan view showing a waveguide portion and microwave radiating portions and a heating chamber, and FIG. 6(*b*) is a side view explaining a relationship between the microwave radiating portions and an electric field in the waveguide portion of a second embodiment according to the present invention.

FIG. 7(*a*) is a plan view showing a waveguide portion and microwave radiating portions and a heating chamber, and FIG. 7(*b*) is a side view explaining a relationship between the microwave radiating portions and an electric field in the waveguide portion of a third embodiment according to the present invention.

FIGS. 8(*a*) and 8(*b*) are diagrams explaining a relationship between a phase of an electric field in the waveguide portion and a directivity of microwave radiated from the microwave radiating portions of the third embodiment according to the present invention.

FIG. 9(*a*) is a plan view showing a waveguide portion and microwave radiating portions and a heating chamber, and FIG. 9(*b*) is a side view explaining a relationship between the microwave radiating portions and an electric field in the waveguide portion of a fourth embodiment according to the present invention.

FIG. 10(*a*) is a plan view showing a waveguide portion and microwave radiating portions and a heating chamber, and FIG. 10(*b*) is a side view explaining a relationship between the microwave radiating portions and an electric field in the waveguide portion of a tenth embodiment according to the present invention.

FIGS. 14(*a*) and 14(*b*) are the diagrams of the configuration of the conventional microwave heating device which generates circular polarization by using the patch antenna.

DETAILED DESCRIPTION OF THE PREFERRED EMBODIMENTS

Figure 1:
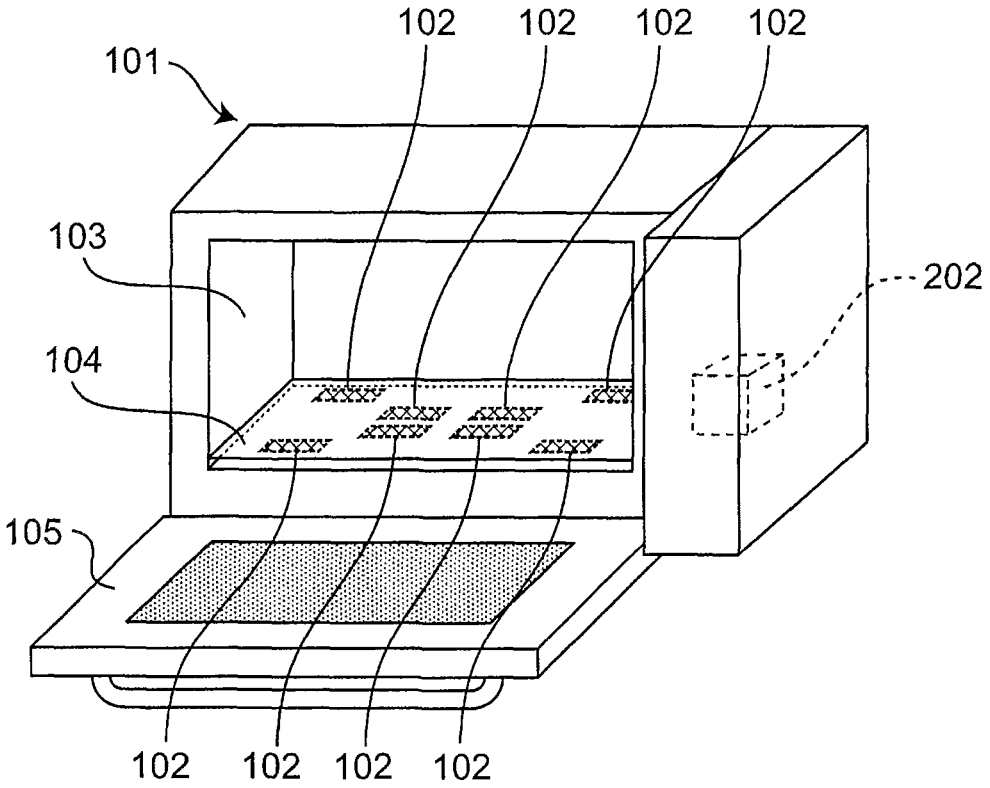
FIG. 1 is a perspective view showing an overall configuration of a microwave heating device of a first embodiment according to the present invention.

A microwave heating device according to a first aspect of the present invention comprises a heating chamber adapted to house an object to be heated;

a microwave generating portion adapted to generate a microwave;

a waveguide portion adapted to propagate the microwave; and a plurality of microwave radiating portions which are provided to the waveguide portion and are adapted to radiate the microwave to inside of the heating chamber, wherein the plurality of microwave radiating portions are arranged in a direction orthogonal to a direction of electric field and to a direction of propagation within the waveguide portion, and centers of at least two microwave radiating portions of the plurality of microwave radiating portions are arranged at positions corresponding to approximate node positions of the electric field within the waveguide portion.

The microwave heating device having the aforementioned structure in the first aspect of the present invention is enabled to spread the microwaves mainly in a direction orthogonal to a direction of electric field and to a direction of propagation within the waveguide portion, and the microwave heating device is configured that the center of at least two microwave radiating portions are arranged at positions of the approximate node positions of the electric field within the waveguide portion. It is possible to spread the microwaves uniformly to the heating chamber, since the radiation direction of the microwaves radiated from the microwave radiating portions spreads mainly in the direction of propagation within the waveguide portion. Therefore, the microwave heating device according to a first aspect of the present invention is enabled to heat the object to be heated uniformly, without employing a driving mechanism.

The microwave heating device according to a second aspect of the present invention is structured that centers of at least two of the microwave radiating portions in the first aspect are arranged at positions of an approximate same phase of the electric field within the waveguide portion. The microwave heating device having this structure in the second aspect is enabled to have same spread of the microwaves from each of the microwave radiating portions, and to heat the object to be heated uniformly, without employing a driving mechanism.

The microwave heating device according to a third aspect of the present invention is structured that centers of at least two of the microwave radiating portions in the first or the second aspect are arranged on same line along a direction of propagation within the waveguide portion. The microwave heating device having this structure in the third aspect is enabled to create a spread of the strong microwaves mainly in the direction orthogonal to the direction of electric field and to the direction of propagation within the waveguide portion in comparison with a case where a single microwave radiating portion is arranged at the approximate node position.

The microwave heating device according to a fourth aspect of the present invention is structured that in a propagation direction of the waveguide portion, a distance from a center of at least one of the microwave radiating portions to an end portion in the propagation direction of the waveguide portion in any one of the first to the third aspect is set to have a length of an integral multiple of about ½ an in-tube wavelength within the waveguide portion. The microwave heating device having this structure in the fourth aspect is enabled to arrange the microwave radiating portions at the approximate node position in exactly and in steadily.

The microwave heating device according to a fifth aspect of the present invention further comprises at least one matching portion for adjusting an impedance in the waveguide portion in any one of the first to the fourth aspect, wherein a distance in the propagation direction of the waveguide portion from a center of at least one of the microwave radiating portions to the matching portion is set to have a length of an integral multiple of about ½ an in-tube wavelength within the waveguide portion. The microwave heating device having this structure in the fifth aspect is enabled to arrange the microwave radiating portions at the approximate node position in exactly and in steadily.

The microwave heating device according to a sixth aspect of the present invention further comprises at least one matching portion for adjusting an impedance in the waveguide portion in any one of the first to the fourth aspect, wherein a center of at least one of the microwave radiating portions is arranged at a position between the matching portion and the end portion in the propagation direction of the waveguide portion. The microwave heating device having this structure in the sixth aspect is enabled to arrange the microwave radiating portions at the approximate node position in exactly and in steadily.

The microwave heating device according to a seventh aspect of the present invention further comprises at least two matching portions in the waveguide portion in any one of the first to the fourth aspect, wherein a center of at least one of the microwave radiating portions is arranged at a position between the adjacent matching portions in the propagation direction of the waveguide portion. The microwave heating device having this structure in the seventh aspect is enabled to arrange the microwave radiating portions at the approximate node position in exactly and in steadily, in comparison with a case where one matching portion is provided in the waveguide portion, or a case where the microwave radiating portions are configured that a distance from the end portion to the center of the microwave radiating portion is set to have a length of an integral multiple of about ½ the in-tube wavelength within the waveguide portion.

The microwave heating device according to an eighth aspect of the present invention is structured that a distance in the propagation direction of the waveguide portion from a center of at least one of the microwave radiating portions in any one of the first to the seventh aspect to the microwave generation portion is set to have a length of an odd multiple of about ¼ an in-tube wavelength within the waveguide portion. The microwave heating device having this structure in the eighth aspect is enabled to arrange the microwave radiating portions at the approximate node position in exactly and in steadily, in comparison with a case where the microwave radiating portions are configured that a distance from the matching portion or the end portion to the microwave radiating portion, or a distance from the matching portion to the end portion is set to have a length of an integral multiple of about ½ the in-tube wavelength within the waveguide portion.

The microwave heating device according to a ninth aspect of the present invention is structured that at least one of the microwave radiating portions in any one of the first to the eighth aspect is adapted to radiate circular polarization. The microwave heating device having this structure in the ninth aspect is enabled to heat the object to be heated in a circumferential direction uniformly because the microwaves are radiated to eddy or rotate as a circular polarization from the center of the microwave radiating portion, when the microwave radiating portions radiate the circular polarization, in comparison with other microwave radiating portions which is adapted to radiate the linear polarization.

The microwave heating device according to a tenth aspect of the present invention is structured that the microwave radiating portion in any one of the first to the eighth aspect is configured to have an X-like form shaped by two elongated openings intersected with each other so as to radiate a circular polarization. The microwave heating device having this structure in the tenth aspect is enabled to radiate steadily the circular polarization with a simple structure.

Hereinafter, preferable embodiments of the microwave heating device according to the present invention will be described, with reference to the accompanying drawings. Further, the microwave heating devices according to the following embodiments will be described with respect to microwave ovens, but these microwave ovens are merely illustrative, and the microwave heating device according to the present invention is not limited to such microwave ovens and is intended to include microwave heating devices, such as heating devices, garbage disposers, semiconductor fabrication apparatuses which utilize dielectric heating. Further, the present invention is also intended to cover proper combinations of arbitrary structures which will be described in the following respective embodiments, wherein such combined structures exhibit their respective effects. Further, the present invention is not limited to the concrete structures of the microwave ovens which will be described in the following embodiments and is intended to cover structures based on similar technical concepts.

First Embodiment

FIGS. 1 to 5 are explanatory diagrams approximate microwave ovens as a microwave heating device of a first embodiment according to the present invention.

FIG. 1 is a perspective view showing an overall configuration of the microwave heating device 101 as the microwave ovens of the first embodiment. (a) of FIG. 2 is a diagram explaining a physical relationship between a waveguide portion 201, microwave radiating portions 102 and a microwave generation portion 202, in terms of a heating chamber 103 of the microwave heating device 101. (b) of FIG. 2 is a diagram explaining a physical relationship between the microwave radiating portions 102, a phase of standing wave 204 (a phase of electric field) induced in the waveguide portion 201, an end portion 203 of the waveguide portion 201, and the microwave generation portion 202, in the waveguide portion 201.

Figure 3:
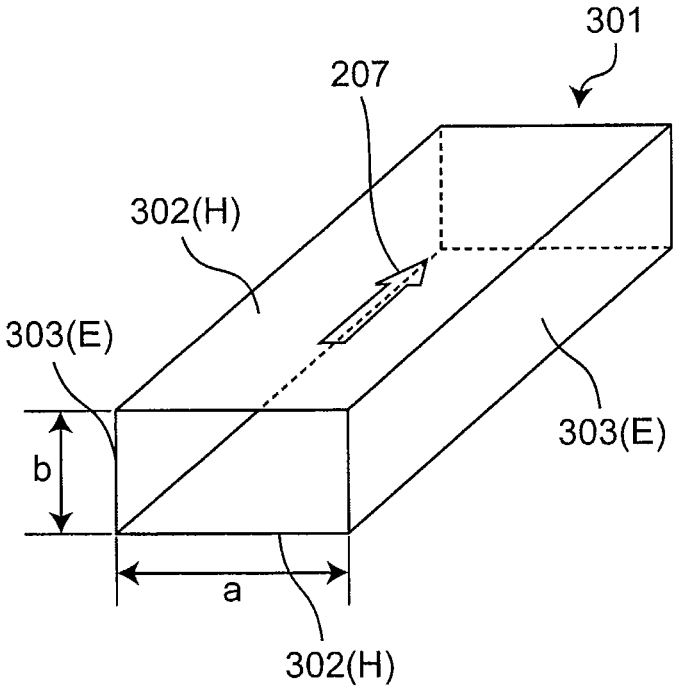
FIG. 3 is a diagram explaining a relationship between an electric field and a magnetic field and a direction of propagation in the waveguide portion in the first embodiment according to the present invention.
Figure 4:
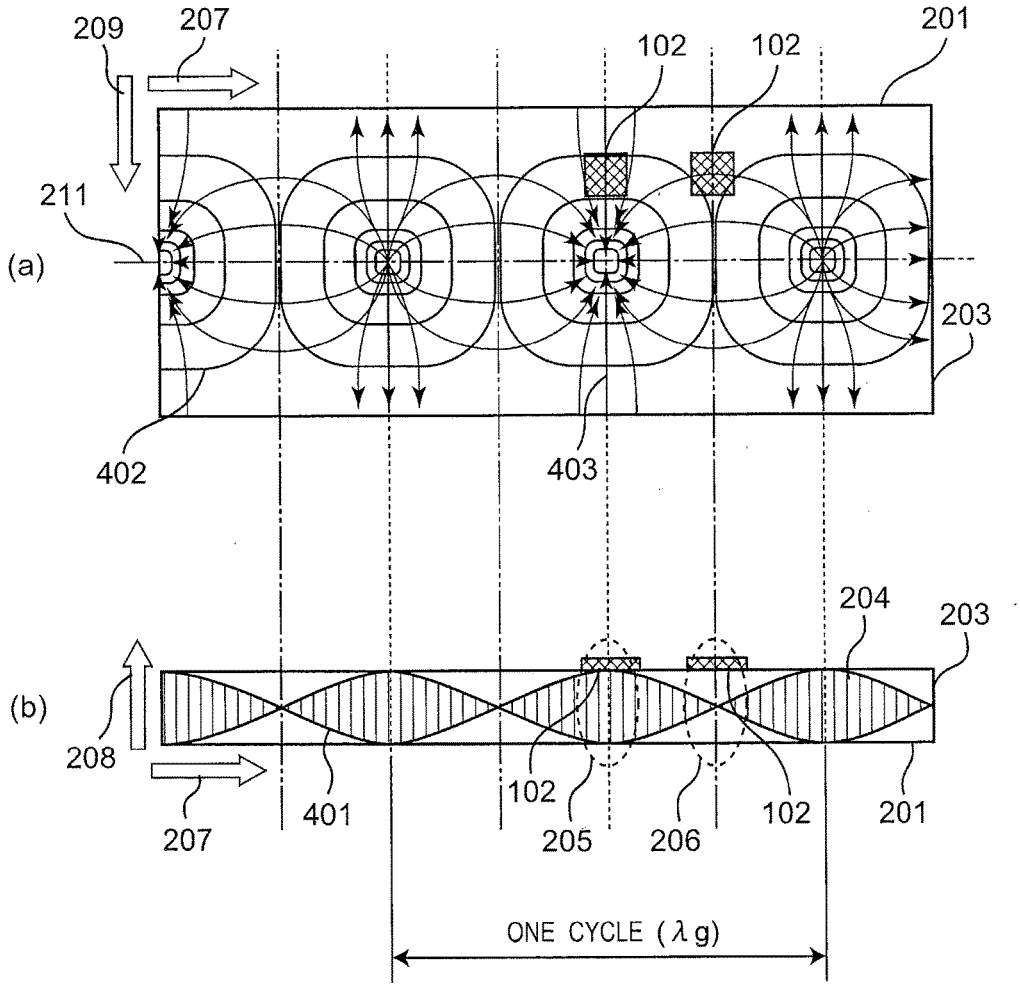
FIGS. 4(*a*) and 4(*b*) are diagrams explaining a relationship between an electric field, a magnetic field, a phase of current and the microwave radiating portions in the waveguide portion of the first embodiment according to the present invention.

FIG. 3 is a perspective view explaining a relationship between size of a general rectangular waveguide tube 301 and a propagation mode. FIG. 4 is a diagram explaining a relationship between the electric field 401, the magnetic field 402, and the current 403, which are generated in the rectangular microwave portion 201. In FIG. 4, (a) is a plan view showing an occurrence condition of the magnetic field 402 and the electric field 403 in the waveguide portion 201, and (b) is a side view showing a relationship between the electric field 401 and the microwave radiating portion 102.

(a) of FIG. 5 is a diagram explaining the relationship between a distance from the end portion 203 to the center of the microwave radiating portion 102 and a phase of a standing wave (electric field 401) within the waveguide portion 201. (b) of FIG. 5 is a diagram explaining the change of spreading microwave radiated in a phase condition of the standing wave within the waveguide portion 201 at a position where the microwave radiating portion 102 is formed. The results showing in FIG. 5 were gotten with an electromagnetic field analysis.

<Structure of Microwave Heating Device>

The microwave heating device 101 of the first embodiment includes a heating chamber 103 which is adapted to house an object to be heated, a microwave generation portion 202 which makes microwaves generated, a waveguide portion 201 which propagates the microwaves generated in the microwave generation portion 202 into the heating chamber 103, and a plurality of microwave radiating portions 102 which are formed on a H-plane of the waveguide portion 201 (see the H-plane of the waveguide tube 301 shown in FIG. 3) to radiate the microwaves within the waveguide portion 201 to inside of the heating chamber 103.

As shown in FIG. 1, the microwave heating device 101 has a placement plate 104 for placing an object to be heated (not illustrated) as well as for covering the upper portion of the waveguide portion 102, and a door 105 which enables the object to be heated to be taken in and out from the heating chamber 103. In the first embodiment, the placement plate 104 is formed by a material that the microwaves are easier to penetrate, such as glass or ceramics.

The above-mentioned structure can be easily achieved by utilizing a magnetron as the microwave generation portion 202, a rectangular waveguide tube 301 as the waveguide portion 201, and opening portions provided on the waveguide portion 201 as the microwave radiating portions 102.

<Outline of Operation in Microwave Heating Device>

First, the microwave heating device 101 that is the microwave oven of the first embodiment will be described with respect to outline of the operation. When a user places the object to be heated on the placement plate 101 within the heating chamber 103, and further, generates a command for start of heating, the magnetron as the microwave generation portion 202 is caused to supply microwaves to the inside of the waveguide portion 201. With supplying the microwaves from the microwave generation portion 202 to the inside of the waveguide portion 201, the microwaves are radiated through the microwave radiating portions 102 which connected between the waveguide portion 201 and the heating chamber 103. As a result, the heating operation is carried out to the object to be heated in the microwave heating device 101.

<Definition of Indirect-Waves and Direct-Waves>

In the present invention, the microwaves, which are radiated from the microwave radiating portions 102 to directly heat the object to be heated, are called direct-waves. Also, the microwaves, which reflect at an inner wall etc. of the heating chamber 103, are call as reflection-waves <Explanations for Sizes of Rectangular Waveguide Portion and TE10 Mode>

Next, with reference to FIG. 3, there will be described a rectangular waveguide portion 301 as a representative waveguide portion which is mounted in a microwave oven. A simplest ordinary waveguide portion is a rectangular-parallelepiped member having a constant rectangular-shaped cross section (width "a"×height "b") which is extended in the direction 207 of propagation, as illustrated in FIG. 7. In the rectangular waveguide tube 301 formed from this rectangular-parallelepiped member, assuming that the wavelength of microwaves is $\lambda$, the width "a" of the waveguide tube 301 is selected within the range of ($\lambda>a>\lambda/2$), and the height "b" of the waveguide tube 301 is selected within the range of ($b<\lambda/2$). By selecting the width "a" and the height "b" of the rectangular waveguide tube 301 as described above, the rectangular waveguide tube 301 is caused to propagate microwaves in the TE10 mode. This has been known.

The TE10 mode refers to a propagation mode with H waves (TE waves; Transverse Electric Waves) having only magnetic-field 402 components while having no electric-field 401 component in the direction 207 of propagation in the rectangular waveguide portion 301, within the rectangular waveguide portion 301. Further, other propagation modes than the TE10 mode are hardly employed in the waveguide portion in the microwave oven.

In the microwave heating device 101, microwaves, which are supplied from the microwave generation portion 202 to the inside of the waveguide portion 201, have wavelengths $\lambda$ of about 120 mm. Generally, in the microwave heating device, the width "a" of the waveguide portion is selected within the range of approximately 80 to 100 mm, and the height "b" thereof is selected within the range of approximately 15 to 40 mm, in many cases.

In the present invention, the upper and lower surfaces of the rectangular waveguide tube 301 shown in FIG. 3 are referred to as H-planes 302 which mean planes in which magnetic fields 402 are eddied in parallel, while the left and right surfaces are referred to as E-planes 303 which mean planes parallel to the electric field 401. Further, assuming that an in-tube wavelength of microwaves being propagated within the waveguide portion 301 is $\lambda g$, $\lambda g$ is expressed as the following equation: $\lambda g=\lambda/\sqrt{1-(\lambda/2a)^2}$ As indicated by the equation, the in-tube wavelength λg is varied depending on the size of the width "a", but is unrelated to the size of the height "b".

Further, in the TE10 mode, the electric field 401 is zero at the opposite end surfaces (the E-planes 303) of the waveguide portion 201 in the widthwise direction, while the electric field 401 is maximized at the center in the widthwise direction. Accordingly, the output of a magnetron as the microwave generating portion 202 is coupled to the waveguide portion 201 at the center thereof in the widthwise direction, at which the electric field 401 is maximized.

<Travelling Wave and Standing Wave within Rectangular Waveguide Tube>

Next, as shown in FIG. 2, in case that a rectangular waveguide tube 301 (see FIG. 3) is used as the waveguide portion 201, the travelling waves from the microwave generation portion 202 and reflection wave reflected at the end portion of the waveguide portion 201 interfere each other, thereby causing occurrence of standing wave 204 within the waveguide portion 201.

A condition of spread in the microwaves radiated from the waveguide portion 201 to the heating chamber 103 varies in accordance with the phase condition of the standing wave 204 (electric field 401) generated within the waveguide portion 201 at forming positions where the microwave radiating portions 102 are formed. The principle of change of spread in the microwaves will be explained below.

First, with reference to FIG. 4, there will be described a relationship between the electric field 401, the magnetic field 402 and the current 403 in the standing wave 204. In the travelling wave, the electric field 401 and the magnetic field 402 have shifted directions at 90 degrees, and the same phase. On the other hand, in the standing wave 204, the electric field 401 and the magnetic field 402 have shifted directions at 90 degrees, and shifted phase at π/2. Therefore, the relationship between the electric field 401 and the magnetic field 402 within the waveguide portion 201 inducing the standing wave 204 comes to be shown in FIG. 4. In the case of the standing wave 204, this is caused mainly by the phase of the electric field 401 shifting π/2, when a travelling wave reflects at the end portion 203 of the waveguide portion 201. In addition, the current 403 flows on the surface of the waveguide portion 201 in a direction orthogonal to the magnetic field 402.

Hereinafter, the principle of the directivity of microwave in case that the microwave radiation part 102 is formed on the H-plane (H-plane 302 of the rectangular waveguide tube 301 shown in FIG. 3) of the waveguide portion 201 inducing the standing wave 204 will be explained below.

As shown in FIG. 4, in the standing wave 204 which is generated in the waveguide portion 201, the case where the microwave radiation portions 102 are formed at approximate anti-node positions 205 and approximate node position 206 will be explained.

Also, the anti-node and the node in the present invention mean strong and weak of the strength of the electric field 401 in the propagation direction 207 within the waveguide portion 201. These do not mean the strength of the electric field 401 in a direction 209 (refer to (a) of FIG. 4) orthogonal to a direction of electric field and to a direction of propagation.

In view of current components in the propagation direction 207 and current components in the direction 209 orthogonal to the direction of electric field and to the direction of propagation in terms of the current 403 of the microwave radiating portions 102, the current 403 flowing in the microwave radiating portions 102 formed at the approximate anti-node position 205 has many components in the direction 209 orthogonal to the direction of electric field and to the direction of propagation.

Since a direction in which the current 403 flows, and a direction in which the electric field 401 spreads are the same, the microwave radiated from the waveguide portion 201 to the heating chamber 103 mainly spreads in the direction 209 orthogonal to the direction of electric field and to the direction of propagation.

On the other hand, the current 403 in the microwave radiating portion 102 formed at the approximate node position 206 has many components of the propagation direction 207. For this reason, the microwave radiated from the waveguide portion 201 to the heating chamber 103 mainly spreads in the propagation direction 207 of the waveguide portion 201.

<CAE of Phase—Directivity>

Next, FIG. 5 shows the relationship between the phase of the electric field 401 of the standing wave 204 within the waveguide portion 201 and a spread of the microwave radiated from the waveguide portion 201 to the heating chamber 103, in the position where the microwave radiating portions 102 are formed. In addition, FIG. 5 shows an electromagnetic-field distribution gotten with the simulation analysis (CAE) by a computer.

In FIG. 5, the node positions of the standing wave 204 are set as be 0 degrees, 180 degrees, and 360 degrees of phases, and the anti-node positions are set as 90 degrees and 270 degrees. The distribution of the microwave radiated from the microwave radiating portions 102 was gotten with the electromagnetic-field analysis in the phases from approximately 0 degree to approximately 180 degrees at intervals of every 45 degrees. In this analysis, the phase of the electric field 401 of the standing wave 204 within the waveguide portion 201 is varied at the position where the microwave radiating portions 102 are formed, by means of changing the distance from the end portion 203 of the waveguide portion 201 to the center of the microwave radiating portion 102. λg in FIG. 5 shows the in-tube wavelength in the waveguide portion 201.

As shown in (b) of FIG. 5, in case that the phase is approximately 0 degree (approximate node position 206 shown in (b) of FIG. 4), the spread of microwaves appears mainly in the propagation direction 207 as mentioned above principle explanation. On the other hand, by shifting approximately 45 degrees of phases, the directivity of microwaves changes counterclockwise. And, in case that the phase is approximately 90 degrees (approximate anti-node position 205 shown in (b) of FIG. 4), the spread of microwaves appears mainly in the direction 209 orthogonal to the direction of electric field and the direction of propagation. This is also consistent with the above-mentioned principle explanation.

By forming the microwave radiating portions 102 at the approximate ant-node position 205 within the waveguide portion 201 as mentioned above, the microwave can be spread to the outside area from the width of the waveguide portion 201, and it becomes possible to heat uniformly the object to be heated in the heating chamber 103.

Next, the analysis conditions of the analysis results shown in FIG. 5 will be mentioned. In this analysis, microwaves generated in the magnetron as the microwave generation portion are propagated with the TE10 mode by using the rectangular waveguide tube 301 shown in FIG. 3.

The rectangular waveguide tube 301 used in this analysis has dimensions that size (thickness; height) in the direction 208 of electric field is 30 mm, and size (width) in the direction 209 orthogonal to the direction of electric field and to the direction of propagation is 100 mm. Also, the frequency of the microwave used for the analysis is set at 2.46 GHz.

Further, the shifting (movement) length of the microwave radiating portions 102, which is required in order to change the spread directions of the microwaves at 90 degrees, is a half of the in-tube wavelength. Since the frequency of the microwave used for the analysis is 2.46 GHz, the shifting length of the microwave radiating portions 102 required in order to change the spread directions of microwave at 90 degrees is set to approximately 39.3 mm.

Also, the shape of the microwave radiating portion 102 used in this analysis is formed with two slits which intersect perpendicularly at the center of each slit, and the two slits are arrange with an inclination of 45 degrees to the propagation direction 207.

Moreover, in the analysis, the number of the microwave radiating portion 102 is one piece, the length of each slit is 55 mm, and displayed data shown in (b) of FIG. 5 is an effective electric field.

<The Anti-Node and the Node of the Standing Wave>

Next, the node position of the standing wave 204 (electric field 401) within the waveguide portion 201 will be described. When the microwaves propagates within the waveguide portion 201 having the end portion 203 as shown in FIG. 2, the standing wave 204 is created in the propagation direction 207 of the microwaves. Since the waveguide portion 201 is closed by the end portion 203, the amplitude at the end portion 203 becomes 0. Also, at the end of the supply side (the output portion) of the microwave generation portion 202, as shown in (b) of FIG. 2, it appears free end having the amplitude which shows the maximum value.

Here, the standing wave 204 which exists in the waveguide portion 201 has a microwave based on the oscillating frequency which is supplied by the microwave generation portion 202. In the present invention, the wavelength of the standing wave 204 is called the in-tube wavelength $\lambda g$.

Therefore, in the waveguide portion 201, the node position of the standing wave 204 arises every about ½ the in-tube wavelength $\lambda g$ from the end portion 203 as base point. Also, the anti-node position of the standing wave 204 arises at the almost center position between the node positions which adjoin each other.

However, there is a case that around theoretical value is arose as the in-tube wavelength $\lambda g$ in the waveguide portion 201. In an actual waveguide tube as the waveguide portion 201, there are many cases that the electric field 401 within the waveguide portion 201 disposed on the periphery of the microwave generation portion 202 be not stabilized, and/or a state on the end portion 203 does not be in an ideal state. Therefore, it is sure to survey amplitude in the waveguide portion 201 for detecting the wavelength of the standing wave 204 in an actual waveguide portion.

<Interference of Radiated Microwave (MW)>

Next, interference of the microwave radiated from the waveguide portion 201 to the heating chamber 103 through the microwave radiating portion 102 will be described.

The mutual interference of the microwave in an arbitrary point is determined by the spread direction of the microwaves radiated from each microwave radiating portion 102, the difference of the distance from each microwave radiating portion 102 to the arbitrary point, and the wavelength of the microwaves within the heating chamber 103. In addition, in the heating chamber 103, it is enhanced each other at the time of an even multiple (0 is included) of ½ the wavelength, and weakened each other at the time of an odd multiple. In case of 2.45 GHz frequency of the microwave used for a common microwave oven, the wavelength in the air in the heating chamber 103 etc. is about 120 mm.

In the construction shown in FIG. 2, a plurality of the microwave radiating portions 102 are formed at the approximate node positions 206. The microwaves having a spread mainly in the propagation direction 207 are radiated from each microwave radiating portion 102, and mutual interferences are generated within the heating chamber 103.

First, on the conditions that two microwave radiating portions 102 are set not to have a distance in the propagation direction 207 of the waveguide portion 201, that is to be formed on the same line, and to have a distance only in the direction 209 orthogonal to the direction of electric field and to the direction of propagation, interference of the microwaves radiated, respectively, to the heat chamber 103 from the two microwave radiating portions 102 arranged at the approximate node position 206 of the standing wave 204 will be described. Since each microwave radiating portion 102 is arranged at the approximate node position 206, the microwaves are radiated to mainly spread in the propagation direction 207.

In this case, it is enough only to mainly consider the interference of the microwave in the propagation direction 207. In this arrangement, since the microwave radiating portions 102 are arranged to have no distance and arranged on the same position in the propagation direction 207, the interference of the microwaves in the propagation direction 207 hardly arises. Therefore, a synthetic wave of the microwaves radiated from the two microwave radiating portions 102 mainly spread in the propagation direction 207 as is case with the spread of the microwaves from each microwave radiating portions 102.

Similarly, a plurality of the microwave radiating portions 102 are considered on the conditions that the microwave radiating portions 102 are arranged to have a distance in the direction 209 orthogonal to the direction of electric field and to the direction of propagation as well as to have a distance in the propagation direction 207, and are arranged at the approximate node position, respectively. Since each microwave radiating portion 102 is arranged at the approximate node position 206, the microwaves spread mainly in the propagation direction 207. In this case, it is enough only to mainly consider the interference of the microwaves in the propagation direction 207.

The strength of the microwave distribution due to the interference varies according to the distance between each of the microwave radiating portions 102 provided on the waveguide portion 201. However, in the case that each microwave radiating portion 102 is arranged at the approximate node position 206, it shows the same condition that the spread of the synthetic wave of the microwaves radiated from microwave radiating portions 102 has a strong directivity in the propagation direction 207 mainly.

<Concrete Structure, Operation and Effect>

Hereinafter, a concrete structure, an operation and an effect of the microwave oven 101, which is the microwave heating device according to the first embodiment of the present invention, will be described.

The microwave oven 101 as a microwave heating device according to the first embodiment includes the heat chamber 103 which houses an object to be heated, the microwave generation portion 202 which generates microwave, the waveguide portion 201 which propagates the microwaves, and the microwave radiating portions 102 which radiate the microwaves to the inside of the heating chamber 103. A plurality of the microwave radiating portions 102 are arranged in the direction 209 (widthwise direction) orthogonal to the direction of electric field and to the direction of propagation within the waveguide portion 201. Moreover, each microwave radiating portion 102 is arranged at the approximate node position 206 of the standing wave (electric field 401) within the waveguide portion 201.

Moreover, since the standing wave at the supply side of the microwave generation portion 202 becomes the free end having the maximum amplitude as shown in (b) of FIG. 2, the position of the supply side is the approximate anti-node position 205, as mentioned above. Therefore, the distance in the propagation direction 207 from the microwave generation portion 202 to the center of the microwave radiating portion 102 is set to have a length of an odd multiple of approximately ¼ the in-tube wavelength λg of the microwaves in the waveguide portion 201. The center position of the microwave radiating portion 102 is set at the approximate node position 206. With the construction in the microwave heating device of the first embodiment, all the microwave radiating portions 102 are arranged at the approximate node position to have the above-mentioned distance. In the specification of the present application, the centers of the microwave radiating portions 102 refer to the substantially center position of the opening for radiating the microwaves, for example, refer to the positions of the centers of gravity in the plate members forming the respective opening shapes, assuming that these respective opening shapes are formed from the plate members having the same thickness.

In the structure of the microwave heating device according to the first embodiment, the microwaves are radiated from the plurality microwave radiating portions 102 which are arranged in the direction 209 orthogonal to the direction of electric field and to the direction of propagation within the waveguide portion 201. Therefore, the microwave heating device according to the first embodiment is configured to radiate the microwaves to the outside area over the width of the waveguide portion 201 so as to spread the microwaves mainly in the direction 209 orthogonal to the direction of electric field and to the direction of propagation within the waveguide portion 201. As described above, since the microwaves are radiated on the outside area over the width of the waveguide portion 201, the microwave heating device according to the first embodiment is enabled to heat the object to be heated uniformly, without employing a driving mechanism.

Further, in the microwave heating device according to the first embodiment, the microwave radiating portions 102 are arranged in at least two rows, and each of the microwave radiating portions 102 is arranged at approximate node position along the propagation direction of the waveguide portion 201. Therefore, it is possible to radiate the microwaves with the spread in the direction 209 orthogonal to the direction of electric field and to the direction of propagation, and in the propagation direction 207, respectively. The microwave heating device according to the first embodiment is enabled to make uniform heat distribution in the object to be heated, without employing a driving mechanism.

Moreover, in the microwave heating device according to the first embodiment, the distance in the propagation direction 207 from the microwave generation portion 202 to the center of each microwave radiating portion 102 is set to have the length of an odd multiple of approximately ¼ the in-tube wavelength λg within the waveguide portion 201. As a result, the microwave radiating portions 102 can be exactly and concretely arranged at approximate node position 206.

In addition, according to the electromagnetic-field analysis shown in FIG. 5, it is considered that the plurality of the microwave radiating portions 102 are arranged in the direction 209 (widthwise direction) orthogonal to the direction of electric field and to the direction of propagation within the waveguide portion 201, as well as arranged at approximate anti-node position 205.

However, in a case of the above-mentioned structure that the microwave radiating portions 102 are arranged at the approximate anti-node position 205, since the plurality of the microwave radiating portions 102 are arranged in the direction 209 orthogonal to the direction of electric field and to the direction of propagation within the waveguide portion 201, the radiated microwaves spreads in the direction 209 orthogonal to the direction of electric field and to the direction of propagation within the waveguide portion 201. In addition, since the microwave radiating portions 102 are arranged at the approximate anti-node position 205, the radiated microwaves spreads further in the direction 209 orthogonal to the direction of electric field and to the direction of propagation within the waveguide portion 201. Therefore, in order to realize uniformly heating of the object to be heated, it is necessary to provide more microwave radiating portions 102 along the propagation direction 207 in the waveguide portion 201.

However, in case that many microwave radiating portions 102 are formed on an inner wall of the heating chamber 103, which divides between the heating chamber 103 and the waveguide portion 201, the sum of the opening space which constitutes the microwave radiating portions 102 becomes large. As a result, the following problems of at least two points arise.

The first point is that the danger that the mechanical strength of the inner wall of the heating chamber 103 between the heating chamber 103 and the waveguide portion 201 produces a deterioration, and then it is in great danger such as the microwave heating device 101 be damaged by the shock due to falling the object to be heated, etc.

The second point is that the quantity of the microwaves, which return in the waveguide portion 201 through the microwave radiating portions 102, increases. The microwaves, which are radiated in the heating chamber 103 from the microwave radiating portions 102, reflects with the inner wall of the heating chamber 103 etc. when the microwaves are not absorbed into the object to be heated. As mentioned above, if many microwaves return in the waveguide portion 201, the generation state of the standing wave 204 in the waveguide portion 201 will be disturbed. As a result, the position of the microwave radiating portions 102 arranged at the approximate anti-node position 205 (and approximate node position 206) shifts, and the radiation direction and the radiant quantities of microwaves become unstable.

Therefore, the following structure has an effect in that the mechanical strength of the microwave heating device 101 itself be improved and the radiation of the microwaves be stabilized: The plurality of the microwave radiating portions 102 are arranged in the direction 209 orthogonal to the direction of electric field and to the direction of propagation within the waveguide portion 201, and further the microwave radiating portions 102 are arranged only at the approximate node position 206.

In addition, in the microwave heating device of the present invention, it is not necessary to arrange the centers of all the microwave radiating portions 102 at the approximate node position 206 like the structure shown in FIG. 2.

The present invention includes a structure in which the centers of at least two microwave radiating portions 102 are arranged at the approximate node position 206 of the electric field 401 within the waveguide portion 201. Also, the present invention includes structures in which the number and the position of the microwave radiating portions 102 are arranged to be asymmetry to the center 210 of the heat chamber 103, and the microwave radiating portion 102 is formed to have a different shape from a rectangle shape.

Moreover, the present invention includes a structure which has only two microwave radiating portions 102, and is configured that each center of the two microwave radiating portions 102 is arranged at approximate node position 206 of the electric field 401 within the waveguide portion 201.

Second Embodiment

Hereinafter, a microwave oven as a microwave heating device according to a second embodiment of the present invention will be described, with reference to FIG. 6. FIG. 6 is a diagram explaining a microwave oven as a microwave heating device according to the second embodiment of the present invention. In FIG. 6, components having the same functions and structures as those of the components of the microwave heating device according to the first embodiment will be designated by the same reference characters. Further, fundamental operations according to the second embodiment are similar to the operations according to the aforementioned first embodiment and, therefore, in the following description, different operations, effects and the like of the second embodiment from the operations according to the first embodiment will be described.

FIG. 6 is the diagram explaining a physical relationship between microwave radiating portions 102 and a phase of the standing wave (electric field 401) generated in a waveguide portion 201, as well as an end portion 203 of the waveguide portion 201 and a microwave generation portion 202. (a) of FIG. 6 is a plan view explaining a physical relationship between the waveguide portion 201, the microwave radiating portions 102, and the microwave generation portion 202, in the heating chamber 103 of the microwave heating device 101. (b) of FIG. 6 is a side view explaining a physical relationship between the microwave radiating portions 102, a phase of a standing wave (electric field 401) generated in the waveguide portion 201, the end portion 203 of the waveguide portion 201, and the microwave generation portion 202, in the waveguide portion 201.

The microwave heating device 101 of the second embodiment includes a heating chamber 103 which is adapted to house an object to be heated, a microwave generation portion 202 which makes microwaves generated, a waveguide portion 201 which propagates the microwaves, and microwave radiating portions 102 which radiate the microwaves to inside of the heating chamber 103. The second embodiment is configured that a plurality of the microwave radiating portions 102 are arranged in tandem toward a direction 209 (widthwise direction) orthogonal to a direction of electric field and to a direction of propagation within the waveguide portion 201. Each microwave radiating portion 102 in tandem is disposed at a position having the approximately same phase, and at the approximate node position 206.

Also, as aforementioned in the first embodiment, the end portion 203 of the waveguide portion 201 is at the approximate node position 206, because the amplitude of the standing wave at the end portion 203 becomes 0 as shown in (b) of FIG. 6. Therefore, the distance in the propagation direction from the end portion 203 of the waveguide portion 201 to the center of the microwave radiating portion 102 is set to have a length of an integral multiple of about ½ the in-tube wavelength λg within the waveguide portion 201. The centers of the microwave radiating portions 102 are positioned on the approximate node position 206. The structure of the second embodiment is configured that each microwave radiating portion 102 is arranged so that the distance form the end portion 203 has a length of an integral multiple of about ½ the in-tube wavelength λg within the waveguide portion 201, as mentioned above.

Though the aforementioned first embodiment was explained using FIG. 4, if the microwave radiating portions 102 are positioned at the node position 206, when the phase of the electric field 401 within the waveguide portion 201 is different from the state shown in FIG. 4, the directions of the electric field 401 and the magnetic field 402 vary, and become opposite directions. For this reason, the main spread directions of the microwaves from the microwave radiating portions 102 vary, and become opposite directions.

Therefore, the structure that the microwave radiating portions 102 are formed to have the approximately same phase of the electric field 401 in the waveguide portion 201, and that at least two microwave radiating portions 102 are arranged at the approximate node position 206, is enabled to heat the object to be heated uniformly in comparison with a structure that the microwave radiating portions 102 are formed to have difference phases of the electric field 401, even if at least two microwave radiating portions 102 are arranged at the approximate node position 206. In the waveguide portion 201, the approximate anti-node position 205 and the approximate node position 206 do not change temporally, and only the directions of the electric field 401 and the magnetic field 402 reverses every half cycle.

As mentioned above, the microwave heating device of the second embodiment is configured that the microwaves from the plurality of the microwave radiating portions 102, which are arranged in the direction 209 orthogonal to the direction of electric field and to the direction of propagation within the waveguide portion 201, are radiated to the inside of the heating chamber 103. Therefore, in the microwave heating device of the second embodiment, the microwaves spread mainly in the direction 209 orthogonal to the direction of electric field and to the direction of propagation within the waveguide portion 201. Also the microwaves can be radiated to the outside area from the width of the waveguide portion 201. As a result, the microwave heating device according to the second embodiment is enabled to heat uniformly the object to be heated, without employing a driving mechanism.

And, in the microwave heating device of the second embodiment, at least two microwave radiating portions 102 are positioned on the approximately same phase of the electric field 401 in the waveguide portion 201. Therefore, the microwave heating device of the second embodiment is configured that the microwaves can be radiated uniformly in the direction 209 orthogonal to the direction of electric field and to the direction of propagation, and in the propagation direction 207, respectively, in comparison with the structure that the microwave radiating portions 102 are positioned on the approximate node position 206 having different phases. As a result, the microwave heating device according to the second embodiment is enabled to make uniform heat distribution of the object to be heated, without employing a driving mechanism.

Further, the microwave heating device of the second embodiment is configured that the distance in the propagation direction from the end portion 203 of the waveguide portion 201 to the center of the microwave radiating portion 102 is set to have the length of the integral multiple of about ½ the in-tube wavelength λg within the waveguide portion 201. Therefore, the microwave radiating portions 102 are enabled to be arranged at the approximate node position 206 in exactly, and in concretely.

Also, in the microwave heating device of the second embodiment, as a microwave radiating portion 601 shown in FIG. 6, it is not necessary to dispose all microwave radiating portions at the position of the approximately same phase and at the approximate node position 206. The microwave radiating portion 601 shown in FIG. 6 indicates an example of a difference microwave radiating portion from the microwave radiating portions 102 which are disposed at positions of the approximate same phase and at positions of the approximate node position 206. As shown in FIG. 6, if at least two microwave radiating portions 102 are disposed at positions having the approximately same phase and at the approximate node position 206, the present invention also covers a case where other microwave radiating portion 601 is disposed on the difference condition from the microwave radiating portions 102.

Further, in the microwave heating device of the present invention, the number and arrangement of the microwave radiating portions 102 are not limited to the structure of the second embodiment, and are suitably set up in consideration of the specification, structure and the like of the microwave heating device. In cases where the microwave radiation portions 102 are asymmetric about the center 210 of the heating chamber (refer to (a) of FIG. 6) in reference to the arrangement of the microwave radiating portions 102, and where the microwave radiating portions 102 are formed in a shape except the ellipse shape as shown in (a) of FIG. 6 in reference to the form of the microwave radiating portions, the same effects are produced and these cases are contained in the present invention.

Third Embodiment

Hereinafter, a microwave oven as a microwave heating device according to a third embodiment of the present invention will be described, with reference to FIGS. 7 and 8. FIGS. 7 and 8 are diagrams explaining a microwave oven as a microwave heating device according to the third embodiment. In FIGS. 7 and 8, components having the same functions and structures as those of the components of the microwave heating device according to the aforementioned first embodiment and the second embodiment will be designated by the same reference characters. Further, fundamental operations according to the third embodiment are similar to the operations according to the aforementioned first embodiment and the second embodiment and, therefore, in the following description, different operations, effects and the like of the third embodiment from the operations according to other embodiment will be described.

FIG. 7 is the diagram explaining a physical relationship between microwave radiating portions 102 and a phase of a standing wave (electric field 401) generated in a waveguide portion 201, as well as a physical relationship in an end portion 203 of the waveguide portion 201, a microwave generation portion 202 and a matching portion 701 for adjusting impedance. (a) of FIG. 7 is a plan view explaining a physical relationship between the waveguide portion 201, the microwave radiating portions 102, the microwave generation portion 202 and the matching portion 701 for the impedance adjustment, in the heating chamber 103 of the microwave heating device 101. (b) of FIG. 7 is a side view explaining a physical relationship between the microwave radiating portions 102, a phase of a standing wave (a generation state of an electric field 401) generated in the waveguide portion 201, an end portion 203 of the waveguide portion 201, the matching portion 701, and the microwave generation portion 202 in the waveguide portion 201.

The microwave radiating portion 102 in the microwave heating device 101 of the third embodiment has a shape which is formed by crossing two slits, as shown in (a) of FIG. 7. As a result, the microwave radiating portions 102 in the third embodiment is configured to radiate a circular polarization to the heating chamber 103.

(a) of FIG. 8 is a diagram explaining a relationship in a distance from the matching portion 701 for adjusting the impedance to the center of the microwave radiating portion 102 and the phase of the standing wave (electric field 401) in the waveguide portion 201. The matching portion 701 is provided in the waveguide portion 201. (b) of FIG. 8 is a diagram explaining a change of the directivity of the radiated microwaves in corresponding to the phase condition of the standing wave (electric field 401) in the waveguide portion 201 in respect to the position where the microwave radiating portions 102 are provided.

<The Matching Portion for the Impedance Adjustment>

First, there will be described the matching portion 701 for the impedance adjustment, which is used in the microwave heating device of the third embodiment.

When the matching portion 701 is arranged at the approximate node position 206 in the waveguide portion 201 as shown in FIG. 7, the amplitude at the position of the matching portion 701 will become 0 and the approximate node position 206 of the electric field 401 in the phase of the standing wave 204 will be certainly formed at the matching portion 701. In the third embodiment, the matching portion 701 is formed by using the metal of a cylindrical shape, and this metal surface has the same function as the fixed end portion of the waveguide portion 201.

Therefore, by arranging the matching portion 701 at the approximate node position 206 of the electric field 401 in the waveguide portion 201, it is possible to fix the approximate anti-node positions 205 and the approximate node positions 206 at stable positions in the waveguide portion 201, even in a process that an electric field distribution within the waveguide portion 201 collapses due to the microwaves radiated from the microwave radiating portion 102 to the inside of the heating chamber 103, and then a stable electric field distribution is re-formed in the waveguide portion 201 again. Moreover, it is mentioned that the microwaves reflected with the inner wall and the like of the heating chamber 103 returns into the waveguide portion 201 through the microwave radiating portion 102, as other factor for collapsing the electric field distribution in the waveguide portion 201. As mentioned above, even if the electric field distribution in the waveguide portion 201 collapses, the approximate anti-node position 205 and the approximate node position 206 of the electric field 401 are stably formed at the predetermined positions in the waveguide portion 201, because the microwave heating device of the third embodiment is configured that the matching portion 701 is disposed at the predetermined position in the waveguide portion 201.

By the action of the matching portion 701 which is provided as mentioned above, an axis of symmetry of an intersection of the above-mentioned microwave radiating portion 102 with the wall current 403 (see (a) of FIG. 4) of the waveguide portion 201 is stabilized. For this reason, since the microwave radiating portion 102 interrupts the wall current 403 of the waveguide portion 201, it is possible to stabilize the spread of the microwaves radiated from the microwave radiating portion 102 to the heating chamber 103.

Moreover, in the structure of the third embodiment, if the distance between the adjacent matching portions 701 would be set at about ½ the in-tube wavelength λg in the waveguide portion 201, it is possible to form naturally the electric field distribution in the waveguide portion 201 with the wavelength which tends to occur in the waveguide portion 201. For this reason, in the microwave heating device 101 as a microwave heating device of the third embodiment, it is possible to propagate the microwaves at high efficiency and to heat with the microwaves at high efficiency and in the stabilized condition.

In addition, in the third embodiment, since the amplitude at the position of the matching portion 701 becomes 0 and the position of the matching portion 701 becomes the approximate node position 206, the approximate node position 206 exists at the position which has a length of the integral multiple of about ½ the in-tube wavelength λg in the waveguide portion 201 from the matching portion 701. Therefore, it is possible to determine easily and certainly the position where the microwave radiating portions 102 are formed at the approximate node position 206 by measuring the distance from the matching portion 701.

The structure shown in FIG. 7 indicates an example that the matching portion 701 is arranged at the center (on the center axis 211) in the direction 209 (widthwise direction) orthogonal to the direction of electric field and to the direction of propagation within the waveguide portion 201. Even if the matching portion 701 is shifted from the center in the widthwise direction of the waveguide portion 201, the same effect is produced Moreover, in the third embodiment, since the metal of cylindrical shape is used as the matching portion 701, the matching portion 701 is easily realizable. In addition, at least the matching portion 701 is required to make a place where the amplitude just becomes 0. The matching portion 701 may be configured to have a concave and convex surface of the inner wall of the waveguide portion 201 or to have a metal member formed in a quadratic prism and the like, and the same effect is produced.

<Phase and CAE of the Directivity>

Next, a relationship between the phase of the electric field 401 of the standing wave 204 within the waveguide portion 201, and the spread of the microwaves radiated from the waveguide portion 201 to the heating chamber 103 is explained with respect to positions of the microwave radiating portions 102. (a) of FIG. 8 is a diagram explaining a relationship between a distance [×λg] from the matching portion 701 to the center of the microwave radiating portion 102, and a phase [deg.] of the standing wave (electric field 401). (b) of FIG. 8 is a diagram explaining a change of the spread of the radiated microwaves in response to the phase condition of the standing wave within the waveguide portion 201, with respect to the positions where the microwave radiating portions 102 are provided. The results shown in FIG. 8 were gotten from an electromagnetic-field distribution gotten with the simulation analysis (CAE) by a computer.

The explanation about FIG. 8 is the same as explanation of FIG. 5 of the first embodiment. FIG. 8 shows a change of about 45 degrees of phases of the electric field 401 within the waveguide portion 201 every about ⅛ long of the in-tube wavelength λg with respect to the distance from the matching portion 701 to the center of the microwave radiating portion 102. Also, FIG. 8 shows a change of the main spread directions of the microwaves radiated into the inside of the heating chamber 103 in corresponding to the phase of the electric field 401 within the waveguide portion 201.

<Structure>

Hereinafter, the structure of the microwave oven which is the microwave heating device 101 according to the third embodiment of the present invention will be described. As shown in FIG. 7, the microwave oven as the microwave heating device 101 of the third embodiment includes the heating chamber 103 which is adapted to house the object to be heated, the microwave generation portion 202 which makes microwaves generated, the waveguide portion 201 which propagates the microwaves, the matching portion 701 for the impedance adjustment, and the microwave radiating portions 102 which radiate the microwaves to the inside of the heating chamber 103. The plurality of the microwave radiating portions 102 in the third embodiment (two microwave radiating portions are provided in the third embodiment) are arranged along the direction 209 (widthwise direction) orthogonal to the direction of electric field and to the direction of propagation so as to have a predetermined interval each other. Also, each of the microwave radiating portions 102 is disposed at the approximate node position 206 of the electric field 401 within the waveguide portion 201.

Further, in the microwave heating device 101 according to the third embodiment, as shown in (b) of FIG. 7, the microwave radiating portion 102 is arranged at the center position between the end portion 203 of the waveguide portion 201 and the matching portion 701. Since the amplitude of the electric field 401 in the waveguide portion 201 becomes O at the end portion 203 of the waveguide portion 201 and the matching portion 701, the end portion 203 and the matching portion 701 are arranged at the approximate node position 206. In order to dispose the microwave radiating portion 102 at the approximate node position 206 generated in an area between the end portion 203 of the waveguide portion 201 and the matching portion 701, the microwave radiating portion 102 in the third embodiment is arranged at the center position between the end portion 203 of the waveguide portion 201 and the matching portion 701. Further, in the third embodiment, the microwave radiating portions 102 are arranged at approximate node positions 206 each having a length of an integral multiple of about ½ the in-tube wavelength λg within the waveguide portion 201.

By means of arrangement that the plurality of the microwave radiating portions 102 are arranged to have an interval only in the direction 209 (widthwise direction) orthogonal to the direction of electric field and to the direction of propagation within the waveguide portion 201, it is possible to obtain a spread of strong microwaves mainly to the direction 209 orthogonal to the direction of electric field and to the direction of propagation within the waveguide portion 201, in comparison with the case where microwave is radiated by the single microwave radiating portion 102.

As described above, the microwave heating device 101 according to the third embodiment is configured to radiate the microwaves from the plurality of the microwave radiating portions 102 into the inside of the heating chamber 103 by means that the plurality of the microwave radiating portions 102 are arranged in the direction 209 orthogonal to the direction of electric field and to the direction of propagation within the waveguide portion 201. Therefore, the microwave heating device 101 according to the third embodiment is adapted to spread the microwaves mainly in the direction 209 orthogonal to the direction of electric field and to the direction of propagation within the waveguide portion 201. As mentioned above, the microwave heating device 101 according to the third embodiment is enabled to further radiate the microwaves to the outside area from the width of the waveguide portion 201. And further, the microwave heating device according to the third embodiment is enabled to heat uniformly the object to be heated, without employing a driving mechanism.

Further, the microwave heating device according to the third embodiment is configured that the distances from the matching portion 701 to the center of the microwave radiating portions 102 in the propagation direction 207 of the waveguide portion 201 is set to have the length of an integral multiple of about ½ the in-tube wavelength kg within the waveguide portion 201, and/or the microwave radiating portions 102 are disposed at a position between the end portion 203 of the waveguide portion 201 and the matching portion 701. Therefore, the microwave radiating portions 102 are enabled to be arranged at the approximate node position 206 in the waveguide portion 201 in exactly, and in steadily.

Also, in the microwave heating device 101 according to the third embodiment, it is not necessary to disposed the all microwave radiating portions 102 at the approximate node position 206 as the structure shown in (a) of FIG. 7. If at least two microwave radiating portions 102 are arranged, in the propagation direction 207, at positions between the end portion 203 of the waveguide portion 201 and the matching portion 701, and/or at positions having the length of the integral multiple of about ½ the in-tube wavelength λg within the waveguide portion 201 from the matching portion 701, the same effects are produced as of the structure of the third embodiment, and these cases are contained in the present invention.

Further, in the microwave heating device according to the third embodiment, an amount, arrangements and shapes of the microwave radiating portions are not limited to the structure of the third embodiment, and are set arbitrary in view of specifications, structures and the like of the microwave heating device. Further, the present invention is intended to cover structures that the microwave radiating portions are arranged to be asymmetric about the center 210 (see (a) of FIG. 7), and that the microwave radiating portions are configured to have shapes except the shape formed by two slits which are intersected with each other as shown in (a) of FIG. 7, and these structures exhibit the same effects.

Fourth Embodiment

Hereinafter, a microwave oven as a microwave heating device according to a fourth embodiment of the present invention will be described, with reference to FIG. 9. FIG. 9 is diagrams explaining a microwave oven as a microwave heating device according to the fourth embodiment. In FIG. 9, components having the same functions and structures as those of the components of the microwave heating device according to the embodiments form the aforementioned first embodiment to the third embodiment will be designated by the same reference characters. Further, fundamental operations according to the fourth embodiment are similar to the operations according to the aforementioned embodiments from the first embodiment to the third embodiment and, therefore, in the following description, different operations, effects and the like of the fourth embodiment from the operations according to other embodiment will be described.

FIG. 9 is the diagram explaining a physical relationship between microwave radiating portions 102 and a phase of a standing wave (electric field 401) generated in a waveguide portion 201, as well as a physical relationship between an end portion 203 of the waveguide portion 201, a microwave generation portion 202 and a matching portion 701 for adjusting impedance. (a) of FIG. 9 is a plan view explaining a physical relationship between the waveguide portion 201, the microwave radiating portions 102, the matching portion 701, and the microwave generation portion 202, in a heating chamber 103 of the microwave heating device 101 as the microwave oven. (b) of FIG. 9 is a side view explaining a physical relationship between the microwave radiating portions 102, the phase of the standing wave (phase of the electric field 401) generated in the waveguide portion 201, the end portion 203 of the waveguide portion 201, the matching portion 701, and the microwave generation portion 202, in the waveguide portion 201.

First, the structure of the microwave heating device 101 according to the fourth embodiment of the present invention will be described.

As shown in FIG. 9, the microwave heating device 101 of the fourth embodiment includes the heating chamber 103 which is adapted to house the object to be heated, the microwave generation portion 202 which makes microwaves generated, the waveguide portion 201 which propagates the microwaves, the matching portion 701 for the impedance adjustment, and the microwave radiating portions 102 which radiate the microwaves to the inside of the heating chamber 103. The plurality of the microwave radiating portions 102 in the fourth embodiment are arranged to have an interval in a direction 209 (widthwise direction) orthogonal to a direction of electric field and to a direction of propagation. Each of the microwave radiating portions 102 is disposed at the approximate node position 206 of the electric field 401 within the waveguide portion 201.

In the microwave heating device 101 according to the fourth embodiment, as shown in (b) of FIG. 9, the microwave radiating portions 102 are arranged at the approximate node position 206 which has a length of an integral multiple of about ½ the in-tube wavelength kg within the waveguide portion 201 from the matching portion 701.

Further, in the microwave heating device 101 according to the fourth embodiment, the microwave radiating portion 102 is formed by arranging two slits in a V shape. Therefore, the microwave radiating portions 102 are configured to radiate the circular polarization to the heating chamber 103.

In the structure of the fourth embodiment shown in (b) of FIG. 9, the matching portion 701 made from metal has a hemispherical shape, and is arranged at the approximate node position within the waveguide portion 201. With the arrangement of the matching portion 701, the amplitude in the position of the matching portion 701 becomes 0, and the approximate node position 206 of the electric field 401 in the phase of the standing wave 204 is formed at the matching portion 701 steadily.

As mentioned above, the microwave heating device according the fourth embodiment is configured to radiate the microwaves from the plurality of the microwave radiating portions 102 which are arranged along the direction 209 orthogonal to the direction of electric field and to the direction of propagation within the waveguide portion 201. Therefore, the radiated microwaves spread mainly in the direction 209 orthogonal to the direction of electric field and the direction of propagation within the waveguide portion 201, and the microwaves can be radiated to the outside area from the width of the waveguide portion 201. As a result, the microwave heating device according the fourth embodiment is enabled to make uniform heat distribution of the object to be heated, without employing a driving mechanism.

Further, in the microwave heating device according the fourth embodiment, the distance in the propagation direction 207 from the matching portion 701 to the center of microwave radiating portions 102 is set to have the length of the integral multiple of about ½ the in-tube wavelength kg within the waveguide portion 201. Therefore, the microwave radiating portions 102 are enabled to be arranged at the approximate node position 206 in the waveguide portion 201 in exactly, and in steadily.

Further, in the microwave heating device according to the fourth embodiment, even if a microwave radiating portion 601 is arranged at the approximate ant-node position as shown in FIG. 9, the present invention contains this case on the condition that at least two microwave radiating portions 102 are arranged at the approximate node position having the length of the integral multiple of about ½ the in-tube wavelength λg within the waveguide portion 201 from the matching portion 701. Also, an amount, arrangements and shapes of the microwave radiating portions are not limited to the structure of the fourth embodiment, and are set arbitrary in view of specifications, structures and the like of the microwave heating device. Further, the present invention is intended to cover structures that the microwave radiating portions may be arranged to be asymmetric about the center 210 (see (a) of FIG. 9), and that the microwave radiating portions may be configured to have shapes except the shape formed by two slits in V shape as shown in (a) of FIG. 9. These structures have directivity, and exhibit the same effects as the aforementioned effect of the fourth embodiment if the structure is enabled to radiate the microwaves of the circular polarization.

Fifth Embodiment

Figure 11:
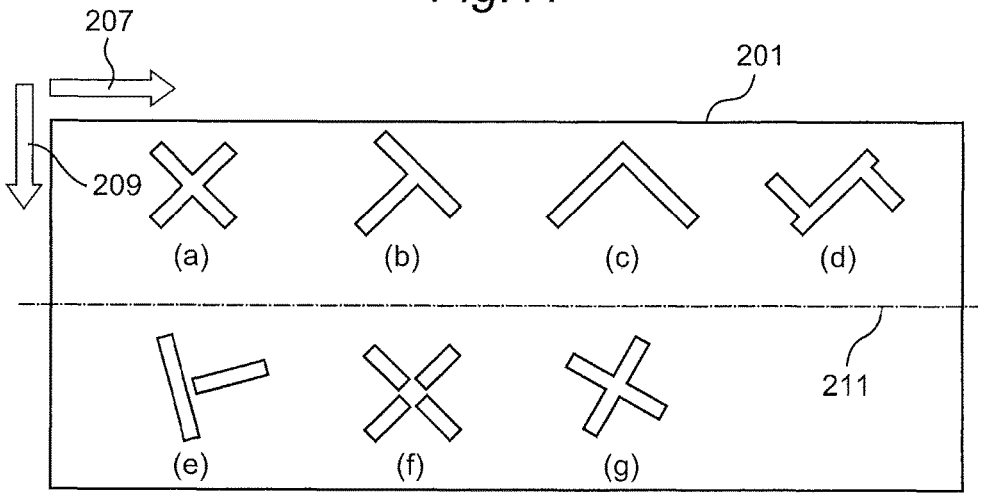
FIG. 11 is a diagram explaining shape examples of microwave radiating portions of a fifth embodiment according to the present invention.
Figure 12:
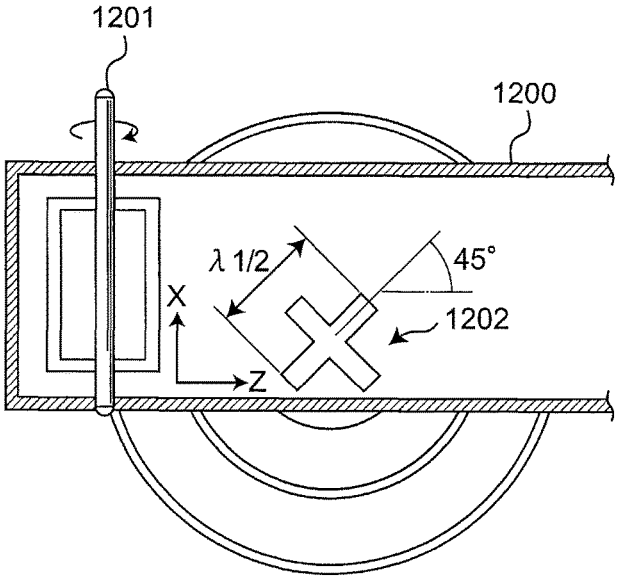
FIG. 12 is the diagram of the configuration of the conventional microwave heating device which generates circular polarization at the opening having the X shape.

Hereinafter, a microwave oven as a microwave heating device according to a fifth embodiment of the present invention will be described. FIGS. 10 and 11 are diagrams explaining a microwave oven 101 as a microwave heating device according to the fifth embodiment. In FIGS. 10 and 11, components having the same functions and structures as those of the components of the microwave heating device according to the embodiments form the aforementioned first embodiment to the fourth embodiment will be designated by the same reference characters. Further, fundamental operations according to the fifth embodiment are similar to the operations according to the aforementioned embodiments from the first embodiment to the fourth embodiment and, therefore, in the following description, different operations, effects and the like of the fifth embodiment from the operations according to other embodiment will be described.

FIG. 10 is the diagram explaining a physical relationship between microwave radiating portions 102 and a phase of a standing wave (electric field 401) generated in a waveguide portion 201, as well as a physical relationship between an end portion 203 of the waveguide portion 201, a microwave generation portion 202 and a matching portion 701 for adjusting impedance. (a) of FIG. 10 is a plan view explaining a physical relationship between the waveguide portion 201, the microwave radiating portions 102, 601, the matching portion 701, and the microwave generation portion 202, in the heating chamber 103 of the microwave heating device 101 as the microwave oven. (b) of FIG. 10 is a side view explaining a physical relationship between the microwave radiating portions 102, 601, the phase of the standing wave (generation state of the electric field 401) generated in the waveguide portion 201, the end portion 203 of the waveguide portion 201, the matching portion 701, and the microwave generation portion 202, in the waveguide portion 201.

<About Circular Polarization and Linear Polarization>

First, the features of the circular polarization radiated from the microwave radiating portions 102, 601, and the advantages of the microwave heating using the circular polarization will be described.

Circular polarization is a technique which has been widely utilized in the fields of mobile communications and satellite communications, and examples of familiar usages of these communications include ETCs (Electronic Toll Collection Systems) "Non-Stop Automated Fee Collection Systems". A circularly-polarized wave is a microwave having an electric field with a polarization plane which is rotated, with time, with respect to the direction of radiowave propagation. When such a circularly-polarized wave is created, the direction of its electric field continuously changes with time. Therefore, microwaves being radiated within the heating chamber 103 exhibit the property of continuously changing in angle of radiation, while having a magnitude of an electric-field intensity being unchanged with time.

With the above mentioned advantages, in the microwave heating device which comprises the microwave radiating portions 102, 601 radiating the circular polarization, in comparison with microwave heating using linearly-polarized waves, which have been used in conventional microwave heating device, it is possible to dispersedly radiate microwaves over a wider range, thereby enabling uniform microwave heating on objects to be heated. Particularly, there is a higher tendency of uniform heating in the circumferential direction of such circularly-polarized waves.

Further, circularly-polarized waves are sorted into two types, which are right-handed polarized waves (CW: clockwise) and left-handed polarized waves (CCW: counter clockwise), based on their directions of rotations. However, there is no difference in heating performance between the two types.

Contrary to the circular polarization, the microwaves within the waveguide portion are linearly-polarized microwaves with electric fields and magnetic fields which are oscillating in constant directions. In the conventional ordinary microwave heating device adapted to radiate linearly-polarized waves within heating chamber, in order to alleviate non-uniformity of the microwave distribution within the heating chamber, there has been installed a mechanism for rotating a table for placing an object to be heated thereon, a mechanism for rotating an antenna for radiating microwaves through a waveguide portion within the heating chamber, or the like.

The microwave heating device according to the fifth embodiment is configured to radiate the microwaves of the circular polarization from the waveguide portion 201 to the inside of the heating chamber 103. Therefore, the microwave heating device of the fifth embodiment enables to absorb the standing wave which arises from interference of the direct wave and reflected wave in the heating chamber, and which has been the problem in the microwave heating of the conventional microwave heating device with the linear polarization. As a result, it is possible to realize uniform microwave heating.

<Definition of Circular Polarization Including Elliptic Polarization>

The circular polarization in the present invention does not mean to include only a case where the microwaves from the microwave radiating portions 102, 601 spread with a state of an exact perfect circle, but also a case where the microwaves spread with a state of an ellipse etc. In the circular polarization of the present invention, the direction of the electric field 401 continues changing according to time, and the radiation angle of the microwaves radiated to the inside of the heating chamber 103 also continues changing according to time. Therefore, in the present invention, the circular polarization is defined as a polarization having a function that the magnitude of the electric field does not change in time.

<Difference in Method for Practical Use of Circular Polarization
(Communication—Cooking Through Heating)>

In use of the circular polarization, since there are some different points between a telecommunication field utilized in an open space and a heating field utilized in a closed space, such different points will be described as follows. In the telecommunication field, it is necessary to avoid mixture with other microwave, and to transmit and receive only required information. For this reason, the transmitting side selects and transmits either right-handed polarized waves or left-handed polarized waves, and also the receiving side selects an optimal receiving antenna corresponding to the transmitted polarized waves.

On the other hand, in the heating field, the object to be heated such as food, which does not have directivity, receives the microwaves in particular, instead of the receiving antenna having the directivity. Therefore, it is important only that the object to be heated receives the microwaves in whole equally.

Therefore, in the heating field, it is satisfactory even if the right-handed polarized waves and the left-handed polarized waves are intermingled. However, it is need to prevent becoming a non-uniform microwave distribution due to a position where the object to be heated is disposed, and a shape of the object to be heated, as possible. For example, in case that a circular polarization opening for radiating microwaves of a single circular polarization is provided, it is satisfactory when the object to be heated is disposed just above the circular polarization opening. However, when the object to be heated is arranged at a position shifted from front to back and from side to side of the circular polarization opening, a portion near the circular polarization opening is easy to be heated, and a portion distant from the opening is hard to be heated. As the result, heating unevenness arises in the object to be heated. Therefore, in the microwave heating device, it is desirable to prepare a plurality of the circular polarization openings.

In the microwave heating device of the fifth embodiment, as shown in (a) of FIG. 10, five circular polarization openings which are the microwave radiating portions 102, 601 are arranged in a line along the propagation direction 207 of the waveguide portion 201. Also, two circular polarization openings are arranged in a line along the direction 209 orthogonal to the direction of electric field and to the direction of propagation within the waveguide portion 201. As a result, total of ten circular polarization openings are formed in the microwave heating device of the fifth embodiment. Two circular polarization openings (microwave radiating portions 102, 601) which are arranged in a line along the orthogonal direction 209 in particular, are configured to polarize in opposite directions mutually (right-handed polarized waves or the left-handed polarized waves). It is unable to create such arrangement in the telecommunications field. This arrangement is realized in the present invention for the first time, and is special and unique in the heating field.

<Shape of Circular Polarization Openings>

Next, the shape of the microwave radiating portions 102, 601, which radiate the circular polarization, will be described. In this case, the microwave radiating portions 102, 601 will be described as being constituted by at least two or more slits.

In the structure of the microwave heating device according to the fifth embodiment, as shown (a) of FIG. 10, two microwave radiating portions 102, 601 are provided to have an interval along the direction 209 (widthwise direction) orthogonal to the direction of electric field and to the direction of propagation within the waveguide portion 201, and are arranged at approximate node position 206 of the electric field 401 within the waveguide portion 201. The microwave radiating portion 601 is formed at a position other than an area between the adjacent matching portions 701.

<Circular Polarization Openings Having Real X Shape>

In the microwave heating device according to the fifth embodiment, each of the microwave radiating portions 102, 601, which radiate the circular polarization, is formed in a real X-like form shaped by two elongated openings (slits) intersected to be at right angles with each other. With the above-mentioned structure, the microwave heating device has a shape capable of certainly radiating circularly-polarized waves with a simple structure.

<Circular Polarization Openings Having Compressed X Shape>

As indicated in the microwave heating device of the aforementioned third embodiment shown in FIG. 7, each of the microwave radiating portions 102, 601 is formed by elongated openings intersected with each other such that they are inclined rather than being made orthogonal to each other. Each of the microwave radiating portions 102, 601 has a compressed X-like shape which is constructed by squashing the letter X to be elongated in a widthwise direction (propagation direction 207). In case that the microwave radiating portions 102, 601 having the compressed X-like shapes are used as the polarization openings, the microwave radiating portions 102, 601 are enabled to radiate the microwaves of the circular polarization even if the microwaves are spread with an ellipse state rather than a real circle state. With above-mentioned structure, the center of the microwave radiating portions 102, 601 can be formed near the opposite side-ends (left and right side walls) of the waveguide portion 201 without making the elongated opening of the circular polarization openings small. As a result, the microwave heating device according to the fifth embodiment is enabled to further spread the microwaves mainly in the direction 209 orthogonal to the direction of electric field and to the direction of propagation within the waveguide portion 201. And further, the microwave heating device according to the fifth embodiment is enabled to heat uniformly the object to be heated, without employing a driving mechanism.

As conditions required for a most preferable shape of the microwave radiating portions 102, 601, which is constituted by the two slits (the elongated opening portions), so as to radiate the circularly-polarized waves, there are following three points.

The first point is that each slit should have a longer side with a length equal to or more than about ¼ the in-tube wavelength kg within the waveguide portion 201. The second point is that the two slits should be orthogonal to each other and, also, each slit should have a longer side inclined by an angle of 45 degrees with respect to direction of propagation. And, the third point is as follows. That is, the electric field distribution should not be formed symmetrically with respect to an axis which is coincident to a straight line which is parallel with the direction of propagation in the waveguide portion 201 and, also, passes through a substantially-center portion of the microwave radiating portion 102.

For example, in cases of propagation of microwaves in the TE10 mode, an electric-field 401 has distribution with respect to a symmetry axis which is coincident to the center axis 211 (see (a) of FIG. 10) extending in the direction 207 of propagation in the waveguide portion 201. Therefore, for the shape of the microwave radiating portion 102, 601, it is necessary to impose, thereon, the condition that it should not be placed asymmetrically with respect to the center axis 211 of the waveguide portion 201 in the direction 207 of propagation.

<Circular Polarization Openings Having Other Shape>

(a)-(g) of FIG. 11 is a plan view illustrating examples of shapes of the microwave radiating portions 102, 601 which radiate the circularly-polarized waves for use in the microwave heating device of the present invention. As illustrated in (a)-(g) of FIG. 11, each of the microwave radiating portions 102, 601 is constituted by two or more slits. Only at least a single slit, out of them, is required to have a shape with a longer side inclined with respect to the direction 207 of propagation of microwaves. Therefore, the shapes of the microwave radiating portions 102, 601 can be structured with any shapes capable of creating circularly-polarized waves and, also, can be structured with shapes formed by slits which are not intersected with each other as illustrated in (e) and (f) in FIG. 11, or shapes formed by integrated three slits as illustrated in (d) in FIG. 11.

Figure 13:
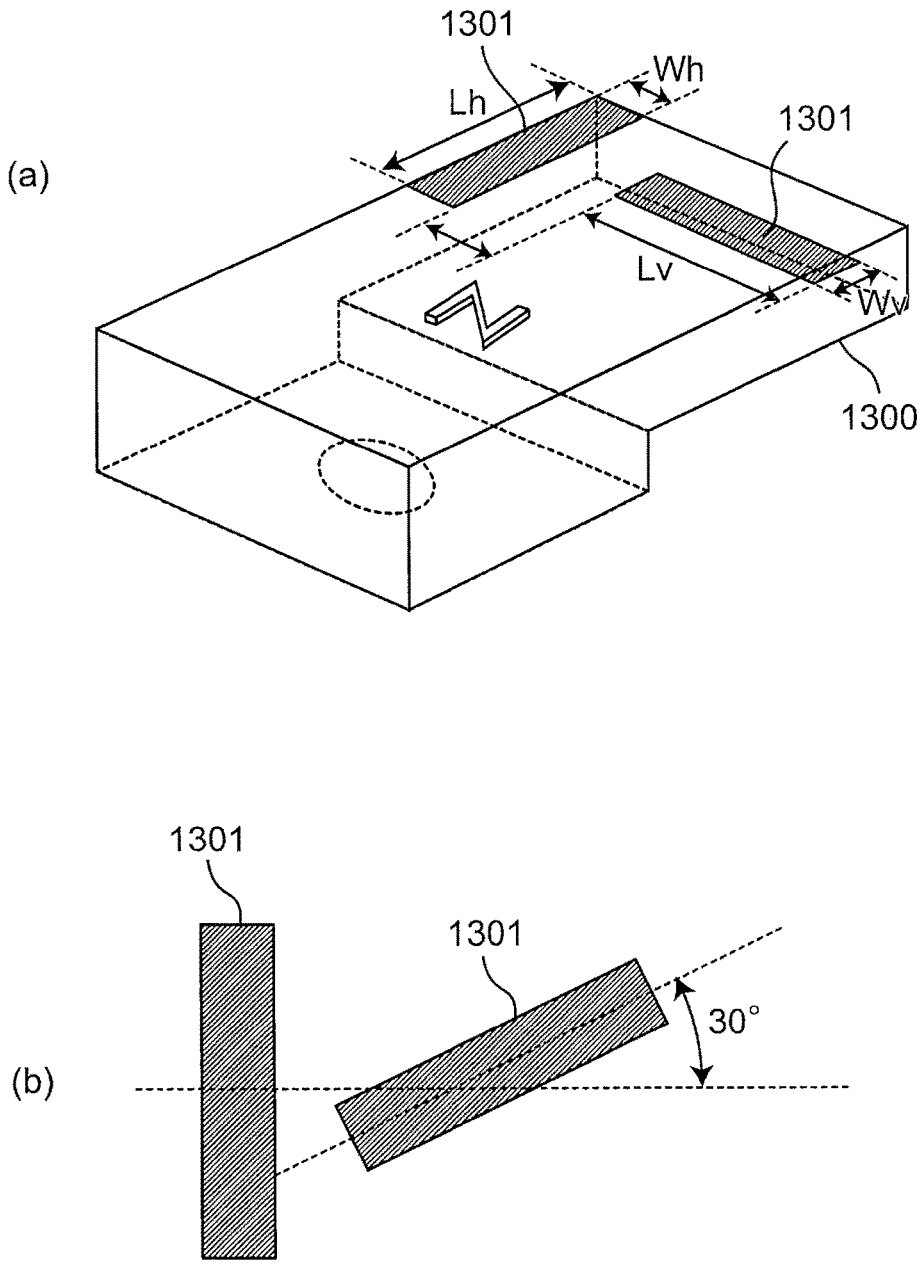
FIGS. 13(*a*) and 13(*b*) are the diagrams of the configuration of the conventional microwave heating device which generates circular polarization by using two rectangular slits right angles to each other.

Further, as illustrated in (a)-(g) of FIG. 11, the microwave radiating portion 102 can be structured with a T shape or an X shape, which is constituted by a plurality of the slits each having a straight-line shape. As aforementioned Patent Literature 2 illustrated in FIG. 13, it is possible to apply such structure to a case where the slits are spaced apart from each other. Further, as illustrated in (b) of FIG. 13, two slits can be inclined, for example, by an angle of about 30 degrees, rather than being orthogonal to each other.

Further, as shown in (b), (c), (d), (e) and (g) of FIG. 11, it is possible to radiate the circularly-polarized waves from a microwave radiating portion having a shape which is not axisymmetrically with respect to an axis parallel to a direction 207 of propagation in the waveguide portion 201, or an axis parallel to a direction orthogonal to the direction of electric field and to the direction of propagation within the waveguide portion 201.

Also, the shapes of the elongated opening portions (slits) of the microwave radiating portion 102 in the fifth embodiment are not limited to rectangular shapes. For example, it is possible to generate circularly-polarized waves by the opening portion formed to have curved surface (R) at their corners, and by the opening portion formed to have an ellipse shape. As basic opening shapes for radiating circularly-polarized waves, it is possible to employ a combination of at least two elongated-hole openings with elongated slit shapes having a larger length in a single direction and a smaller length in the direction orthogonal thereto.

Next, the structure of the microwave heating device 101 according to the fifth embodiment will be described.

As shown in FIG. 10, the microwave heating device 101 of the fifth embodiment includes the heating chamber 103 which is adapted to house the object to be heated, the microwave generation portion 202 which makes microwaves generated, the waveguide portion 201 which propagates the microwaves, the plurality of the matching portions 701 for the impedance adjustment, and the microwave radiating portions 102, 601 which radiate the microwaves having the circularly-polarized waves to the inside of the heating chamber 103. The plurality of the microwave radiating portions 102 in the fifth embodiment are arranged to have an interval in the direction 209 (widthwise direction) orthogonal to the direction of electric field and to the direction of propagation. Each of the microwave radiating portions 102, 601 is disposed at the approximate node position 206 of the electric field 401 within the waveguide portion 201.

Further, in the microwave heating device 101 according to the fifth embodiment, as shown in (b) of FIG. 10, the microwave radiating portions 102 are arranged between the adjacent matching portions 701 and 701 which are disposed to have at least one wavelength interval. These matching portions 701 are positioned at positions where the amplitude of the electric field 401 within the waveguide portion 201 becomes 0, which are the approximate node positions 206. The microwave radiating portions 102 are arranged at the approximate node positions 206 generated between the adjacent matching portions 701 and 701 which are disposed to have at least one wavelength interval.

<Arranging Opening on H-Plane>

The microwave radiating portions 102, 601 which radiate the circularly-polarized waves in the microwave heating device according to the fifth embodiment are constituted by openings having the predetermined shapes on the H-planes, which are the upper and lower surfaces of the aforementioned waveguide portion 301 shown in FIG. 3, and in which magnetic fields are rotated to swirl in parallel. As a result, the microwave radiating portions 102, 601 are structured to radiate certainly the circularly-polarized waves to the heating chamber 103.

Also, as mentioned above, in comparison with the linear polarization, the microwave heating device according to the fifth embodiment is enabled to heat the object to be heated uniformly, through the heating in a circumferential direction with the circularly-polarized waves. Since the microwave radiating portions are arrange to be placed axisymmetrically with respect to the center axis 211 parallel to the direction 209 orthogonal to the direction of electric field and to the direction of propagation within the waveguide portion 201 in particular, the rotating directions of the circularly-polarized waves becomes reverse mutually. Therefore, the magnetic fields in the both center sides of the microwave radiating portions, which are axisymmetrically disposed, has the same rotating direction, and these magnetic fields in the both center sides are not canceled. As a result, the microwave radiating portions are enabled to spread without wasting the microwaves radiated from the waveguide portion 201 to the inside of the heating chamber.

As described above, the microwave heating device according to the fifth embodiment of the present invention is configured that the microwaves are radiated from the plurality of the microwave radiating portions 102, which are arranged to have a distance along the direction 209 orthogonal to the direction of electric field and to the direction of the propagation within the waveguide portion 201, into the inside of the heating chamber 103. In the microwave heating device according to the fifth embodiment, the microwaves spread in the direction 209 orthogonal to the direction of electric field and to the direction of propagation within the waveguide portion 201, and the microwaves radiate to the outside area from the width of the waveguide portion 201. As a result, the microwave heating device according to the fifth embodiment is enabled to make uniform heat distribution of the object to be heated, without employing a driving mechanism.

Further, the microwave heating device according to the fifth embodiment of the present invention is configured to have at least two matching portions 701, and to arrange at least one microwave radiating portion 102 intermediate between the adjacent matching portions 701 and 701. With the above-mentioned structure, the microwave heating device according to the fifth embodiment is enabled to arrange the microwave radiating portion at the approximate node position 206 in more exactly and steadily, for example, in comparison with a case that a distance from one matching portion to a center of a microwave radiating portion is set to have a length of an integral multiple (including 0 multiple) of about ½ the in-tube wavelength λg within the waveguide portion 201.

Also, a case that the distance from the matching portion to the center of the microwave radiating portion is set to have a length of 0 multiple of about ½ the in-tube wavelength λg within the waveguide portion 201 means that the microwave radiating portion is disposed above the matching portion.

Further, in the microwave heating device according to the fifth embodiment of the present invention, since the microwave radiating portions 102, 601 are configured to radiate the circularly-polarized waves, the microwaves are radiated to rotate like a swirl from the center of the circular polarization radiating portion. Therefore, it is possible to heat the object to be heated uniformly in comparison with the conventional microwave radiating portion which radiates the linear polarization. In the structure of the microwave heating device according to the fifth embodiment, particularly it can be expected to uniformly heat the object to be heated in the circumferential direction with the microwave radiating portion 102 which radiates the circularly-polarized waves.

Further, in the microwave heating device according to the fifth embodiment of the present invention, since the microwave radiating portions 102, 601, which radiate the circularly-polarized waves, are formed in an X-like form shaped by two elongated openings intersected, the microwave radiating portions are enabled to radiate steadily the circularly-polarized waves with a simple structure.

Also, like the structure shown in (a) and (b) of FIG. 10, in the microwave heating device according to the present invention, it is not necessary to arrange the all microwave radiating portions 102 at the approximate node positions 206. In the present invention, it is necessary only that at least two microwave radiating portions 102 are disposed between the adjacent matching portions 701, such that the same effects are exhibited as of the fifth embodiment.

Further, in the microwave heating device according to the present invention, the number of and the position of the microwave radiation portion are not limited to the structure of the fifth embodiment, and can be properly determined depending on the specification, the structure and the like of the microwave heating device. The present invention covers a case where the microwave radiating portions are arranged to be asymmetric about the center 210 (see (a) of FIG. 10) of the heating chamber.

Further, the microwave heating device according to the present invention is enabled to make uniform heat distribution of the object to be heated, without employing a driving mechanism, on condition that at least two microwave radiating portions, which radiate the circularly-polarized waves, are disposed at the approximate node position, and the microwave radiating portions are arranged in the direction orthogonal to the direction of electric field and to the direction of propagation within the waveguide portion.

As mentioned above, the microwave heating device according to the present invention comprises the heating chamber which is adapted to house an object to be heated, the microwave generation portion which makes microwaves generated, the waveguide portion which propagates the microwaves, and the microwave radiating portions which radiate the microwaves inside of the heating chamber. Also, the plurality of the microwave radiating portions are arranged in the direction orthogonal to the direction of electric field and to the direction of propagation within the waveguide portion, and the centers of at least two microwave radiating portions are disposed at the approximate node position of the electric field within the waveguide portion.

As mentioned above, the microwave heating device according to the present invention is configured to radiate the microwaves from the microwave radiating portions, which are arranged along in the direction orthogonal to the direction of electric field and to the direction of propagation within the waveguide portion, to the inside of the heating chamber. Therefore, the radiated microwaves spread mainly in the direction orthogonal to the direction of electric field and to the direction of propagation, and are enable to be radiated in the outside area from the width of the waveguide portion. As a result, the microwave heating device according to the present invention is enabled to make uniform heat distribution of the object to be heated, without employing a driving mechanism.

Further, in the microwave heating device according to the present invention, the spread direction of the radiated microwaves from the microwave radiating portions to the inside of the heating chamber changes in response to the phase of the microwaves within the waveguide portion in respect of the position of the microwave radiating portions. The microwave heating device according to the present invention is enabled to radiate the microwaves having the directivity in the propagation direction of the waveguide portion by arranging the microwave radiating portions at the approximate node position in particular.

Therefore, in the microwave heating device according to the present invention, by disposing the plurality of the microwave radiating portions in the direction orthogonal to the direction of electric field and to the direction of propagation within the waveguide portion, and by disposing at least two microwave radiating portions of them at the approximate node position, the microwave heating device is enable to radiate the microwaves in the direction orthogonal to the direction of electric field and to the direction of propagation within the waveguide portion as well as in the propagation direction, respectively. As a result, the microwave heating device according to the present invention is enabled to make more uniform heat distribution of the object to be heated, without employing a driving mechanism.

Further, by providing the microwave radiating portions which radiate the circularly-polarized waves, the microwave heating device according to the present invention is configured to radiate the microwaves having a spread, which is a feature of the circular polarization, from the microwave radiating portions. Therefore, the microwave heating device according to the present invention is enabled to spread uniformly the radiated microwaves in a more extended area to the object to be heated. It can be expected to uniformly heat the object to be heated in the circumferential direction, especially, because of the microwave heating with circular polarization.

Further, in the microwave heating device according to the present invention, the microwave radiating portion radiating the circular polarization is structured by a simple shape formed by two or more slits. According to the present invention, an improvement in reliability and a miniaturization of the electric supply portion can be realized with a simple structure, in addition to a uniform heating of the object to be heated, without using a driving mechanism.

INDUSTRIAL APPLICABILITY

The microwave heating device according to the present invention can be used effectively in a heating device and the like, which perform a heating processing, a sterilization, etc. of solitary food because the object to be heated can be irradiated uniformly by the microwaves.

The invention claimed is:

1. A microwave heating device comprising:

a heating chamber adapted to house an object to be heated;

a microwave generating portion adapted to generate a microwave;

a waveguide portion adapted to propagate the microwave; and a plurality of microwave radiating portions which are provided to the waveguide portion and are adapted to radiate the microwave to inside of the heating chamber, wherein the microwave radiating portions are adapted to radiate circular polarization, and arranged in a direction orthogonal to a direction of electric field and to a direction of propagation within the waveguide portion, the microwave radiating portions are arranged in at least two rows, and each center of at least two microwave radiating portions of the microwave radiating portions are arranged at positions corresponding to approximate node positions along the propagation direction of the waveguide portion, and a distance in the propagation direction of the waveguide portion from a center of a least one of the microwave radiating portions to the microwave generation portion has a length of an odd multiple of about ¼ of an in-tube wavelength within the waveguide portion.

2. The microwave heating device according to claim 1, wherein each center of at least two of the microwave radiating portions are arranged at positions of an approximate same phase of the electric field within the waveguide portion.

3. The microwave heating device according to claim 1, wherein each center of at least two of the microwave radiating portions are arranged on same line along a direction of propagation within the waveguide portion.

4. The microwave heating device according to claim 1, wherein in a propagation direction of the waveguide portion, a distance from a center of at least one of the microwave radiating portions to an end portion in the propagation direction of the waveguide portion is set to have a length of an integral multiple of about ½ an in-tube wavelength within the waveguide portion.

5. The microwave heating device according to claim 1, further comprising at least one matching portion for adjusting an impedance in the waveguide portion, wherein a distance in the propagation direction of the waveguide portion from a center of at least one of the microwave radiating portions to the matching portion is set to have a length of an integral multiple of about ½ an in-tube wave length within the waveguide portion.

6. The microwave heating device according to claim 1, further comprising at least one matching portion for adjusting an impedance in the waveguide portion, wherein a center of at least one of the microwave radiating portions is arranged at a position between the matching portion and the end portion in the propagation direction of the waveguide portion.

7. The microwave heating device according to claim 1, further comprising at least two matching portions for adjusting an impedance in the waveguide portion, wherein a center of at least one of the microwave radiating portions is arranged at a position between the adjacent matching portions in the propagation direction of the waveguide portion.

8. The microwave heating device according to claim 1, wherein the microwave radiating portion is configured to have an X-like form shaped by two elongated openings intersected with each other so as to radiate a circular polarization.

* * * * *